US011158935B2

(12) United States Patent
Murray et al.

(10) Patent No.: US 11,158,935 B2
(45) Date of Patent: Oct. 26, 2021

(54) EAR-WORN DEVICES WITH HIGH-DIELECTRIC STRUCTURAL ELEMENTS

(71) Applicant: Starkey Laboratories, Inc., Eden Prairie, MN (US)

(72) Inventors: Casey Murray, Eden Prairie, MN (US); Janet Marie Glenn, Bloomington, MN (US); Zhenchao Yang, Eden Prairie, MN (US)

(73) Assignee: Starkey Laboratories, Inc., Eden Prairie, MN (US)

( * ) Notice: Subject to any disclaimer, the term of this patent is extended or adjusted under 35 U.S.C. 154(b) by 0 days.

(21) Appl. No.: 16/723,473

(22) Filed: Dec. 20, 2019

(65) Prior Publication Data

US 2020/0203812 A1 Jun. 25, 2020

Related U.S. Application Data

(60) Provisional application No. 62/783,656, filed on Dec. 21, 2018.

(51) Int. Cl.

| | |
|---|---|
| ***H01Q 1/12*** | (2006.01) |
| ***H01Q 1/27*** | (2006.01) |
| ***H01Q 9/16*** | (2006.01) |
| *H01Q 5/50* | (2015.01) |
| *H04R 25/00* | (2006.01) |
| *H01Q 1/48* | (2006.01) |

(52) U.S. Cl.

CPC ..... *H01Q 1/273* (2013.01); *H01Q 9/16* (2013.01); *H01Q 1/48* (2013.01); *H01Q 5/50* (2015.01); *H04R 25/554* (2013.01); *H04R 25/558* (2013.01)

(58) Field of Classification Search

CPC ..... H01Q 1/273; H01Q 9/16; H01Q 5/50; H01Q 1/48; H04R 25/554; H04R 25/558

USPC ..... 343/718, 878, 893, 702

See application file for complete search history.

(56) References Cited

U.S. PATENT DOCUMENTS

| | | | |
|---|---|---|---|
| 7,652,628 | B2 | 1/2010 | Zweers |
| 9,620,858 | B2 | 4/2017 | Alfano et al. |
| 2008/0272980 | A1 | 11/2008 | Adel et al. |
| 2011/0227796 | A1 | 9/2011 | Kuroda et al. |
| 2013/0234912 | A1 | 9/2013 | Kouchi et al. |
| 2014/0111385 | A1 | 4/2014 | Yamazaki et al. |
| 2015/0131829 | A1 | 5/2015 | Akdeniz et al. |
| 2017/0064467 | A1 | 3/2017 | Fischer et al. |

(Continued)

OTHER PUBLICATIONS

International Search Report and Written Opinion of International Application No. PCT/US2019/068011, dated Apr. 7, 2020, 19 pages.

*Primary Examiner* — Joseph J Lauture

(74) *Attorney, Agent, or Firm* — Shumaker & Sieffert, P.A.

(57) ABSTRACT

Ear-worn devices may include one or more structural elements formed of high-dielectric material. The position and shape of the structural element may be selected relative to an antenna of the ear-worn device to provide specific enhancements of the electric and/or magnetic field generated by the antenna. The structural elements may include a host resin material and a plurality of dielectric material elements. The structural elements may have an effective dielectric constant greater than 5. One or more loading strips may be used to tune a resonating structure formed by the antenna and the structural elements. The antenna may be an antenna array with structural elements disposed between elements of the array.

13 Claims, 22 Drawing Sheets

(56) References Cited

U.S. PATENT DOCUMENTS

| | | | | |
|---|---|---|---|---|
| 2018/0124528 | A1 | 5/2018 | Polinske et al. | |
| 2018/0234781 | A1 | 8/2018 | Stewart et al. | |
| 2019/0111261 | A1 | 8/2019 | Glenn et al. | |
| 2019/0373381 | A1* | 12/2019 | Elghannai ..... | H01Q 9/28 |

* cited by examiner

EAR-WORN DEVICES WITH HIGH-DIELECTRIC STRUCTURAL ELEMENTS

This application claims the benefit of U.S. Provisional Patent Application No. 62/783,656, filed Dec. 21, 2018, the entire content of which is incorporated by reference.

TECHNICAL FIELD

The present disclosure generally relates to ear-worn devices. In particular, the present disclosure relates to the construction of various hearing assistance devices that generate electric fields.

BACKGROUND

Consumer electronics typically include structural components and electronics components. For example, in an ear-worn device, an antenna and a printed-circuit board may be contained within a housing that protects the antenna components and the circuitry. Ear-worn devices including antennas may be used to communicate wirelessly, for example, with other ear-worn devices. However, electric fields generated by antennas for wireless communication are susceptible to signal losses, particularly when worn close to the wearer's head or even in the ear. Signal losses may be even more pronounced when attempting to communicate between ear-worn devices on different sides of a wearer's head (e.g., one device associated with each ear).

SUMMARY

This disclosure generally relates to using a high-dielectric material to form a structural element in an ear-worn device. Structural elements may be used in various parts of ear-worn devices to provide mechanical support and to redirect at least part of electric and/or magnetic fields. Properties of the structural element may be selected to improve characteristics of electrical fields generated by antennas of ear-worn devices, which may facilitate improved communications with other devices. Examples of properties include: the position of the structural element in relation to the wearer or other component of the ear-worn device (e.g., antennas, signal lines, or reflectors), the effective dielectric constant of the structural element, and the position of the structural element in relation to an electric field to be generated by the ear-worn device (e.g., from antennas). Using a structural element made of high-dielectric material, instead of designing the antenna with separate components, may save valuable space in the ear-worn device. In one or more embodiments, an ear-worn device includes an antenna and a housing having a structural element made, at least partially, of a high-dielectric material. The position of the structural element may be selected relative to conductive portions of the antenna to provide specific enhancements of the electric and/or magnetic field.

In one aspect, the present disclosure provides an ear-worn device including an antenna. The antenna includes a conductive material configured to provide an electric field in response to a driving signal. The ear-worn device includes a structural element positioned relative to the antenna. The structural element includes a host resin material and a plurality of dielectric material elements having a dielectric constant greater than the host resin material dispersed in the host resin material to redirect at least part of the electric field toward the structural element.

In another aspect, the present disclosure provides an ear-worn device including an antenna. The antenna includes a conductive material configured to provide an electric field in response to a driving signal. The ear-worn device also includes a structural element positioned relative to the antenna configured to cause the electric field to travel along or away from a wearer of the ear-worn device. The structural element has an effective dielectric constant greater than 5.

In another aspect, the present disclosure provides an ear-worn device including a resonating structure. The resonating structure includes a structural element configured to provide an electric field in response to a driving signal. The structural element includes a host resin material and a plurality of dielectric material elements having a dielectric constant greater than the host resin material dispersed in the host resin material to redirect at least part of the electric field toward the structural element. The ear-worn device also includes one or more conductive loading strips coupled to the structural element to tune the resonating structure.

In yet another aspect, an ear-worn device includes an antenna array. The antenna array has two or more antenna elements formed of a conductive material configured to provide an electric field in response to a driving signal. The ear-worn device also includes a structural element positioned between at least two of the antenna elements. The structural element includes: a host resin material and a plurality of dielectric material elements having a dielectric constant greater than the host resin material dispersed in the host resin material to redirect at least part of the electric field toward the structural element. Sizes of the two or more antenna elements are selected based on an effective dielectric constant of the structural element.

In yet another aspect, an ear-worn device comprises: an antenna comprising a conductive material configured to provide an electric field in response to a driving signal, wherein: the antenna includes a first antenna element, a second antenna element, and an antenna feed point, the antenna feed point is coupled to the first antenna element and the second antenna element and configured to provide the driving signal, and each of the first antenna element and the second antenna element is formed of the conductive material and is configured to provide the electric field in response to the driving signal from the feed point; and a structural element, wherein: at least a part of the structural element is positioned between the first antenna element and the second antenna element, the structural element is one of: a housing of the ear-worn device, a shell of the ear-worn device, a top case of the ear-worn device, a battery door of the ear-worn device, a faceplate of the ear-worn device, or a spine of the ear-worn device, and at least the part of the structural element that is positioned between the first antenna element and the second antenna element comprises a host resin material; and a plurality of dielectric material elements having a dielectric constant greater than the host resin material dispersed in the host resin material.

In yet another aspect, a method of manufacturing an ear-worn device comprises: forming a structural element of the ear-worn device, wherein: the structural element is one of: a housing of the ear-worn device, a shell of the ear-worn device, a top case of the ear-worn device, a battery door of the ear-worn device, a faceplate of the ear-worn device, or a spine of the ear-worn device, and forming the structural element comprises including, in a host resin material that is to comprise at least a part of the structural element, a plurality of dielectric material elements having a dielectric constant greater than the host resin material; and attaching an antenna to the structural element so that at least the part of the structural element that includes the dielectric material elements is positioned between a first antenna element of the antenna and a second antenna element of the antenna, wherein: the antenna comprises a conductive material configured to provide an electric field in response to a driving signal, the antenna includes an antenna feed point that is coupled to the first antenna element and the second antenna element and is configured to provide the driving signal, and each of the first antenna element and the second antenna element is formed of the conductive material and is configured to provide the electric field in response to the driving signal from the feed point.

The details of one or more aspects of the disclosure are set forth in the accompanying drawings and the description below. Other features, objects, and advantages of the techniques described in this disclosure will be apparent from the description and drawings, and from the claims.

DETAILED DESCRIPTION

Figure 1:
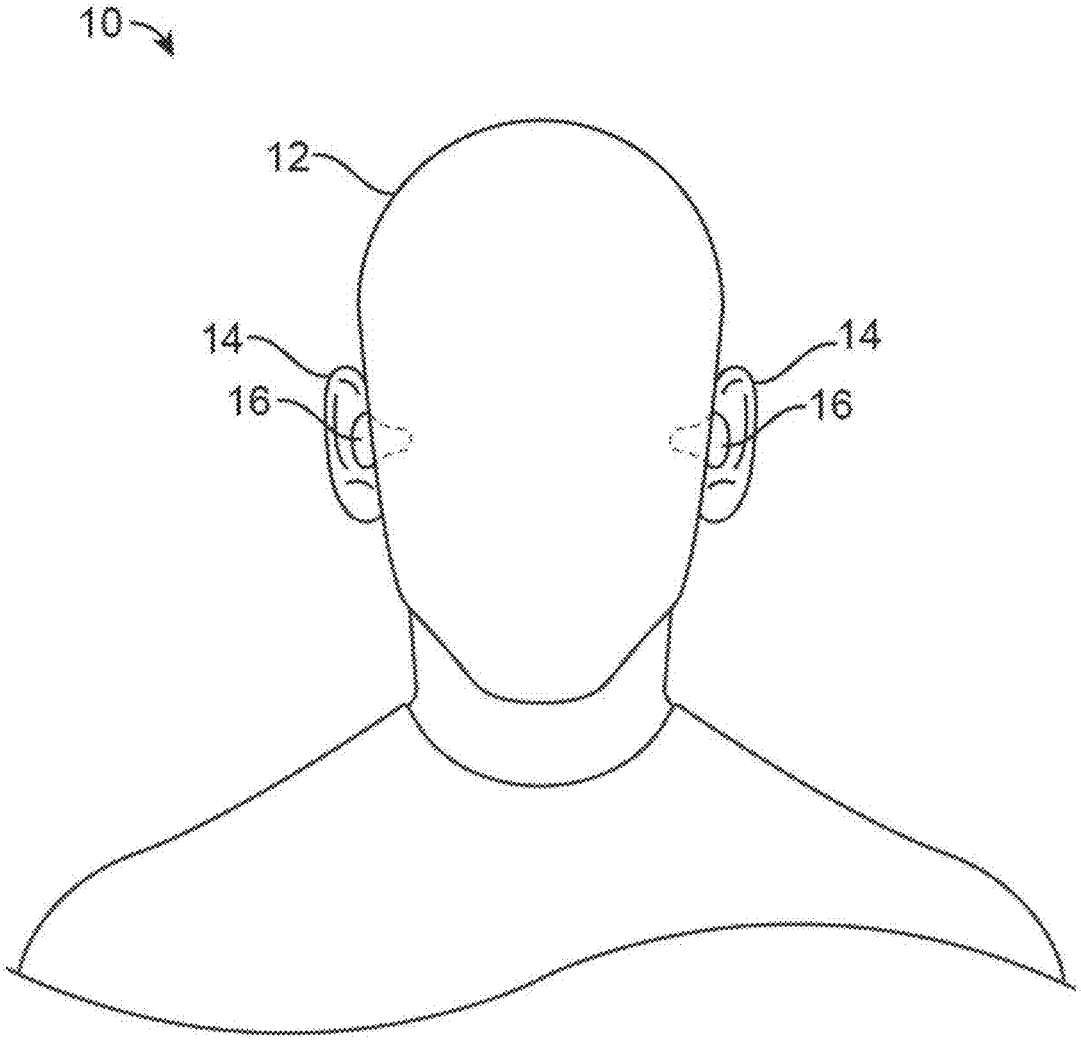
FIG. 1 is an illustration of a wearer of ear-worn devices according to various embodiments of the present disclosure.

This disclosure relates to ear-worn devices that include a high-dielectric structural element. Although reference is made herein to hearing devices, such as a hearing aid, the high-dielectric structural element may be used with any electronic device, particularly in applications where space-saving is beneficial. Non-limiting examples of ear-worn devices include hearing aids, hearable devices (for example, earbuds, Bluetooth headsets, or back-vented vented tweeter-woofer devices), wearables or health monitors (for example, step counter or heartrate monitor), or other portable or personal electronics (for example, smartwatch or smartphone). Various other applications will become apparent to one of skill in the art having the benefit of the present disclosure.

In general, hearing devices may include hearing aids, or hearing assistance devices or instruments, or a device with a transducer for providing personalized sound to the ear of a wearer or user. Hearing aids can be used to assist patients suffering hearing loss by transmitting amplified sounds to one or both ear canals. Such devices typically include hearing assistance components such as a microphone for receiving ambient sound, an amplifier for amplifying the microphone signal in a manner that depends upon the frequency and amplitude of the microphone signal, a speaker or receiver for converting the amplified microphone signal to sound for the wearer, and a battery for powering the components.

In certain types of hearing devices, the hearing assistance components are enclosed by a housing that is designed to be worn in the ear for both aesthetic and functional reasons. Such devices may be referred to as in-the-ear (ITE), in-the-canal (ITC), completely-in-the-canal (CIC), or invisible-in-the-canal (IIC) hearing instruments. Another type of hearing instrument, referred to as a behind-the-ear (BTE) hearing instrument, utilizes a housing that is worn behind the ear that contains all the hearing assistance components including the receiver (e.g., the speaker) that conducts sound to an earbud inside the ear via an audio tube. Another type, referred to as a receiver-in-canal (MC) hearing instrument, also has a housing worn behind the ear that contains all the hearing assistance components except for the receiver, with the output state then being electrically connected to the receiver worn in the ear canal.

Some ear-worn devices may be made custom to a wearer. For example, both the CIC and ITE hearing instruments may be custom, as they are fitted and specially built for the wearer of the instrument. For example, a mold may be made of the wearer's ear or canal for use to build the custom instrument. Other ear-worn devices may be made standard for wearers. Standard hearing instruments may only need to be programmed for the person wearing the instrument to improve hearing for that person. Custom devices may be particularly suitable for use with high-dielectric structural elements when there is a limited amount of space available in the device, for example, when a custom device is designed to fit within the ear of a user.

For example, hearing devices may be used to assist a person suffering from hearing loss by transmitting amplified sound directly to the person's ear canals. In one example, a hearing device is worn in and/or around a person's ear and may be contoured with curved surfaces to facilitate comfort in use. Some hearing devices are portably powered with a battery.

It may be beneficial to provide a high-dielectric structural element that allows an ear-worn device to have a small size while providing an electric field for communication with other devices, such as a smartphone or other ear-worn device on the other ear of the user. It may also be beneficial to provide a high-dielectric structural element that facilitates ease of manufacturing and may be shaped as needed to provide desirable electric field characteristics from the ear-worn device.

The high-dielectric structural element may provide electrical length enhancement for antennas, which may optimize impedance for power delivery to antennas or other radiating structures. For example, an antenna may be positioned on, or in close proximity to, the high-dielectric structural element.

High-dielectric structural elements may have high permittivity ($\varepsilon$) and/or high permeability ($\mu$), which may be used to re-direct electric and/or magnetic fields. Herein, benefits regarding the redirection of electric fields are also generally applicable to the redirection of magnetic fields.

In some embodiments, the high-dielectric structural element may be formed of, or include, a composite material. The composite material may include a host material (e.g., a host resin) and some concentration of particles or other elements with higher permittivity and/or permeability to increase the effective permittivity and/or permeability of the composite material. Such composite materials may be suitable for use in manufacturing components of an ear-worn device, for example, using injection molding or additive processes (e.g., three-dimensional printing).

The elements with higher permittivity and/or permeability may be distributed, or dispersed, in the host material in a uniform, or non-uniform manner. For example, non-uniform distributions may be used to position a higher concentration of the elements near regions of antennas having high current distribution. Some antennas have one or more conductive elements, or antenna elements, which may be used in producing an electric field. In some embodiments, high-dielectric structural elements may be positioned between the conductive elements, for example, where the electric field distribution is high.

One application for high-dielectric structural elements is improving radiation patterns for wireless communication. Improved radiation patterns may benefit both far-field and near-field radiation patterns, for example, for ear-to-ear communication links when a wearer has an ear-worn device on each ear.

Another application for high-dielectric structural elements is enhancing electric field excitation perpendicular to a wearer (e.g., a wearer's head). High-dielectric structural elements may be positioned in close proximity to antennas to create regions of high electric field distribution perpendicular to the wearer's head. In other words, the high-dielectric structural elements may be positioned in proximity to parts of antenna elements where the electrical field is not null.

In some applications, high-dielectric structural elements may be positioned in ear-worn devices in regions that do not interface with the wearer's head or ear. In particular, the structural element may redirect the electric field away from the wearer's head or ear, which may be beneficial in concentrating the electric field in directions that do not interact with lossy mediums, such as the wearer's head or ear.

Further applications may benefit from using an antenna array, which may include antenna elements separated in space. Various parameters of the antenna array may be modified or enhanced by positioning high-dielectric structural elements between the antenna elements in the array.

In addition, various applications may benefit with improved signal integrity when high-dielectric structural elements are positioned to redirect the electric field distributions away from certain signal lines. For example, important or sensitive signal lines may be identified, and structural elements may be positioned to direct the electric field from the antenna away from the identified signal lines. For example, in some hearing devices, there may be significant coupling between the antenna and certain components in the device. A faceplate or case made of, or including, a high-dielectric structural element may help to decouple the antenna from the components in the device, for example, because more of the electric field will be concentrated in the structural element instead of the device's components.

As used herein, the term "nominal antenna wavelength" refers to the wavelength of an antenna corresponding to a physical length of the antenna. In contrast, an "effective antenna wavelength" refers to the wavelength of an antenna when a high-dielectric structural element is in close proximity to the antenna to redirect the electric and/or magnetic field generated by an antenna of an ear-worn device (e.g., changing the field distribution by at least about 10%). The effective antenna wavelength may be longer than, or greater than, the nominal antenna wavelength for the same antenna by having a high-dielectric structural element nearby. In other words, the coupling between the structural element and the antenna may define a current distribution that is equivalent to a physically longer antenna that is not coupled to the structural element.

As used herein, the term "structural element" refers to part or all of a component of an ear-worn device that mechanically supports other components of the ear-worn device. Certain structural elements may be rigid or semi-rigid to provide mechanical support to components of the ear-worn device. In some embodiments, a structural element refers to a non-active component that is not electrically powered. Structural elements may form, for example, part or all of one or more of the following components of an ear-worn device: a housing, a shell, a case, a battery door, a faceplate, a frame, a spine, a printed circuit board, and a substrate. Structural elements may form part of an outer surface of the ear-worn device or may be internal to the ear-worn device.

Reference will now be made to the drawings, which depict one or more aspects described in this disclosure. However, it will be understood that other aspects not depicted in the drawings fall within the scope of this disclosure. Like numbers used in the figures refer to like components, steps, and the like. However, it will be understood that the use of a reference character to refer to an element in a given figure is not intended to limit the element in another figure labeled with the same reference character. In addition, the use of different reference characters to refer to elements in different figures is not intended to indicate that the differently referenced elements cannot be the same or similar.

FIG. 1 shows environment 10 including user 12 and two ear-worn devices 16 having high-dielectric structural elements. Each ear-worn device 16 may be positioned in or near one of the user's ears 14. In some embodiments, ear-worn device 16 is a hearing device or hearing aid. Ear-worn device 16 may include one or more acoustic transducers. Sound that approaches ear 14 of user 12 may be received by a receiving acoustic transducer (for example, a microphone) on ear-worn device 16, which may be positioned to collect sound from the external environment. The sound received may be modulated and/or transmitted toward an ear drum of the ear 14 using a transmitting acoustic transducer (for example, a speaker or receiver), which may be on an opposite end of ear-worn device 16 from the transmitting acoustic transducer.

Ear-worn device 16 typically includes at least one enclosure, housing, or shell, and one or more electronics components, such as one or more transducers (for example, a speaker/receiver and a microphone), hearing device electronics including processing electronics, and one or more power sources (for example, a battery or charge port). The battery may be rechargeable or replaceable. The housing may include a battery door to replace the battery. The components of the ear-worn device 16 may be contained within the housing placed, for example, in the external ear canal or behind the ear. As explained below, depending upon the type of ear-worn device, some of the components may be contained in separate housings.

In general, the housing of ear-worn device 16 includes one or more structural elements of the device. In some embodiments, the housing may include some or all non-active or non-electronic components.

Ear-worn device 16 may include a communication interface. The communication interface may include an antenna. With the communication interface, ear-worn device 16 may communicate with other devices, such as a smartphone, table, or the ear-worn device 16 positioned in or near the other ear 14 of user 12.

In general, ear-worn device 16 may be placed adjacent to or near a surface of the user's head. Ear-worn devices 16 may communicate wirelessly by sending creeping waves that travel along the user's head to the other ear-worn device 16.

Various structural elements of ear-worn device 16 may be made of a high-dielectric material. The high-dielectric material may include any suitable material that provides a high dielectric constant and is capable of being formed into the desired structural element. The high-dielectric material may be formed of one or more material components (e.g., to form a monolithic or composite material). When formed, the structural element may define an effective dielectric constant based on the combined properties of the one or more material components. For example, the effective dielectric constant of a composite material may be calculated using an effective medium approximation, such as the Maxwell Garnett equation. In general, a higher effective dielectric constant may be beneficial in reducing physical antenna size or increasing effective antenna size.

In some embodiments, the effective dielectric constant of the structural element may be greater than or equal to about 3, 4, 5, 6, 7, 8, 9, 10, 15, 20, 25, 30, 40, or even 50. In some embodiments, the effective dielectric constant of the structural element may be less than about 50, 40, 30, 25, 20, 15, 10, 9, 8, 7, 6, 5, or even 4. For example, in some embodiments, the effective dielectric constant of the structural element may be greater than about 5.

One example of a composite material for making a structural element includes a host resin material and a plurality of dielectric material elements. The dielectric material elements may be formed of a high-dielectric material. In some embodiments, each of the dielectric material elements may have a dielectric constant greater than or equal to about 1, 2, 3, 4, 5, 6, 10, 20, 30, or even 50. In some embodiments, the dielectric constant of the dielectric material elements may be less than about 100, 50, 30, 20, 10, 6, 5, 4, 3, or even 2.

In general, the dielectric material elements may be formed of any suitable dielectric material. In some embodiments, the dielectric material elements may be formed at least partially of a metal. For example, the dielectric material elements may be at least partially formed of one or more of the following: titanium, tantalum oxide, cerium oxide, and barium zirconium titanium oxide.

The host resin material may have a dielectric constant with any suitable range. In general, the high-dielectric material has a dielectric constant greater than the host resin material. In some embodiments, the host resin material may have a dielectric constant greater than or equal to about 0.1, 1, 2, 3, 4, 5, 6, 10, 20, or even 30. In some embodiments, the dielectric constant of the host resin material may be less than about 50, 30, 20, 10, 6, 5, 4, 3, 2, or even 1.

In general, the host resin material may be made of any suitable resin. In some embodiments, the host resin material may be formed at least partially of a polymer. For example, the host resin material may be at least partially formed of one or more of the following: a polyamide, a polyimide, a polyamide blend, or a nylon material.

Any suitable proportion of dielectric material elements to host resin material may be used to achieve a desired effective dielectric constant of the structural element. In some embodiments, the structural element may include dielectric material elements in an amount greater than or equal to about 0.01, 0.5, 1, 2, 3, 4, 5, 10, 15, 20, 25, 30, 40, 50 wt.-% of the structural element. In some embodiments, the dielectric material elements may form less than about 80, 50, 40, 30, 25, 20, 15, 10, 5, 4, 3, 2, 1, or 0.5 wt.-% of the structural element.

Structural elements may be formed of high-dielectric material using any suitable technique. In some embodiments, the high-dielectric material may be injection molded or three-dimensionally (3D) printed to form the structural element.

In some embodiments, high-dielectric material may be made by combining a host resin and dielectric material elements, or electrical enhancement objects. When dielectric material elements are dispersed in a host resin, the dielectric material elements may be provided in any suitable form. Non-limiting examples of the form of dielectric material elements include one or more of the following: powder, granular particles, or rods. The host resin material and the dielectric material elements may combine to form a composite material, or high-dielectric material, that can be molded or printed to form the structural element.

The dielectric material elements may be dispersed in the host resin material in any suitable manner. For example, in some embodiments, dielectric material elements may be dispersed uniformly, or at least substantially uniformly, in the host resin material. In other embodiments, dielectric material elements may be dispersed non-uniformly in the host resin material. For example, a non-uniform dispersion may be used with a patch antenna (see FIG. 11). The pattern of dispersion of dielectric material elements in the host resin material may be selected depending on, for example, the desired effect on the electrical field generated by an antenna.

Using the high-dielectric material may allow high-frequency communication structures to be integrated into structural elements or mechanical components (e.g., a faceplate), and structural elements may be used in proximity to high-frequency communication structures (e.g., using dielectric loading to increase electrical antenna length). Further, metallic objects may be used in the host resin for use as a ground plane or reflector for the antenna structure.

Figure 2A:
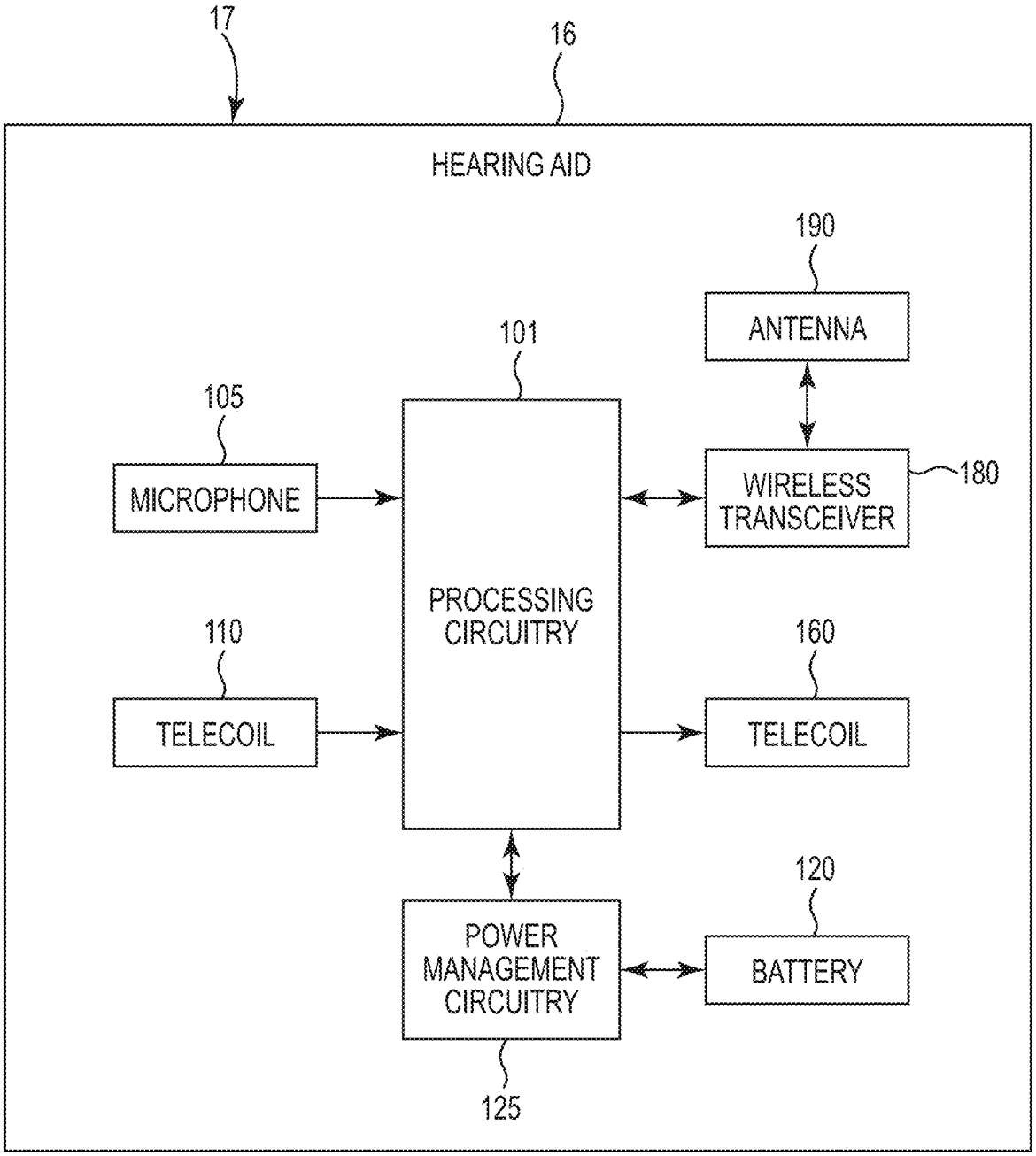
FIGS. 2A-B are (A) a functional diagram of various components of the ear-worn device of FIG. 1 including an antenna and (B) a perspective illustration of one example of the antenna according to various embodiments of the present disclosure.

FIG. 2A shows various functional components that may be used with, for example, ear-worn device 16. In particular, one or more functional components of ear-worn device 16 may be contained within housing 17. One or more microphones 105 may receive sound waves from the environment and may convert the sound into an input signal. The input signal may then be amplified by a pre-amplifier, sampled, and digitized by an A/D converter to result in a digitized input signal. The device's audio signal processing circuitry 101 may process the digitized input signal into an output signal. In the hearing device, processing circuitry 101 may process the input signal in a manner that compensates for the patient's hearing deficit. Processing circuitry 101 may be implemented in a variety of different ways, such as with an integrated digital signal processor or with a mixture of discrete analog and digital components that include a processor executing programmed instructions contained in a processor-readable storage medium. The output signal may then be passed to an audio output stage that drives speaker 160 (also referred to as a receiver) to convert the output signal into an audio output. Battery 120 operated by power management circuitry 125 may supply power for the hearing device components.

Hearing devices may incorporate wireless transceivers that enable communication between the two hearing devices typically worn by a user as well as communication between a hearing device and an external device such as an external programmer or an audio streaming source such as a smartphone. In the case of ear-to-ear communication, the link between the hearing devices may be implemented as a near-field magnetic induction (NFMI) link operated in a frequency band between about 3 and 15 MHz which easily propagates through and around the human head. The frequency band used for NFMI links, however, has a very limited propagation range. Therefore, in the case of communications between a hearing device and an external device, far-field RF (radio-frequency) links using higher frequency bands such as the 900 MHz or 2.4 GHz ISM (Industrial Scientific Medical) bands may be used in some cases. Wireless transceivers also may use an antenna for radio transmission and reception such that the hearing instrument incorporates one or more antennas.

Device 16 may include wireless transceiver 180 interfaced to the hearing instrument's processing circuitry and connected to the feed point of an antenna (or antennas) 190 for transmitting and/or receiving radio signals. In general, antenna 190 may be formed of any suitable conductive material capable of providing an electric field in response to a driving signal. Wireless transceiver 180 may be used to provide electrical driving signals to antenna 190.

Wireless transceiver 180 may enable ear-to-ear communications between the two hearing instruments as well as communications with an external device. Such long-range communication may be possible using Bluetooth, Wi-Fi (802.x), or other standards such as 802.15.x. Wireless communication may include direct connection to a cellular network using GSM, CDMA, TDMA, 4G, LTE and the like. When receiving an audio signal from an external source, wireless transceiver 180 may produce a second input signal for the processing circuitry that may be combined with the input signal produced by the microphone 105 or used in place thereof.

Device 16 may also include telecoil 110 (also referred to as a T-coil for "telephone coil") which is a small device that detects the electromagnetic field generated by audio induction loops such as the speaker of a telephone handset. The signal from the telecoil may be digitized and fed to processing circuitry 101 where it may be mixed with the microphone signal to generate the audio output for the hearing instrument wearer, for example, when the hearing instrument is operating in a telecoil mode. The telecoil mode may be activated manually via a user input or may be activated automatically when the presence of a magnetic field produced by the magnet of a telephone speaker is sensed by, for example, a magnetometer.

One or more structural elements may be positioned in ear-worn device 16 relative to antenna 190. In particular, structural elements may be positioned to redirect at least part of an electric field generated by antenna 190 toward the structural elements. In some embodiments, structural elements may be positioned between antenna 190 and an outer surface of ear-worn device 16, which may redirect at least part of the electric field outside of ear-worn device 16. In some embodiments, structural elements may be positioned to cause the electric field to travel along or away from a wearer of the ear-worn device.

Structural elements may be positioned in proximity to antenna 190 to exert an effect on electric fields. In some embodiments, antennas 190 are positioned on or adjacent to structural elements. In other embodiments, antennas 190 are not in direct contact with structural elements. Structural elements may be positioned in areas near antennas 190 where the electric field generated by the antenna is strong or near portions of antennas 190 where the current is high (e.g., near radiating areas of the antennas).

Some structural elements may be positioned to exert an effect on electric fields that decouples antennas 190 from internal signal lines. For example, without high-dielectric structural elements, sensitive signal lines may be affected by the presence of strong electrical and/or magnetic fields. Positioning structural elements to couple to antennas 190 may reduce coupling between the antennas and certain internal signal lines, which may reduce the electrical and/or magnetic field distribution around the internal signal lines. In some embodiments, a structural element may be disposed closer to a first side of antenna 190 than a second side of antenna 190. The first side may be opposite to the second side. The internal signal line may be disposed closer to the second side than the first side of the antenna 190, so that field distribution may be redirected away from the internal signal line toward the structural element.

One or more of the components, such as processing circuitry and power management circuitry, described herein may include a processor, such as a central processing unit (CPU), computer, logic array, or a device capable of directing data coming into or out of ear-worn device 16. Such circuitry, which may also be described as being, or being part of, a controller, may include one or more computing devices having memory, processing, and communication hardware. The circuitry may couple various components of the circuit together or with other components operably coupled to the circuit. The functions of the circuitry may be performed by hardware and/or as computer instructions on a non-transient computer readable storage medium.

The processor of the circuitry may include any one or more of a microprocessor, a microcontroller, a digital signal processor (DSP), an application specific integrated circuit (ASIC), a field-programmable gate array (FPGA), and/or equivalent discrete or integrated logic circuitry. In some examples, the processor may include multiple components, such as any combination of one or more microprocessors, one or more controllers, one or more DSPs, one or more ASICs, and/or one or more FPGAs, as well as other discrete or integrated logic circuitry. The functions attributed to the circuitry or processor herein may be embodied as software, firmware, hardware, or any combination thereof. While described herein as a processor-based system, an alternative circuit could utilize other components such as relays and timers to achieve the desired results, either alone or in combination with a microprocessor-based system.

In one or more embodiments, the exemplary systems, methods, and interfaces may be implemented using one or more computer programs using a computing apparatus, which may include one or more processors and/or memory. Program code and/or logic described herein may be applied to input data/information to perform functionality described herein and generate desired output data/information. The output data/information may be applied as an input to one or more other devices and/or methods as described herein or as would be applied in a known fashion. It will be readily apparent that the circuitry functionality as described herein may be implemented in any manner known to one skilled in the art having the benefit of this disclosure.

Figure 2B:
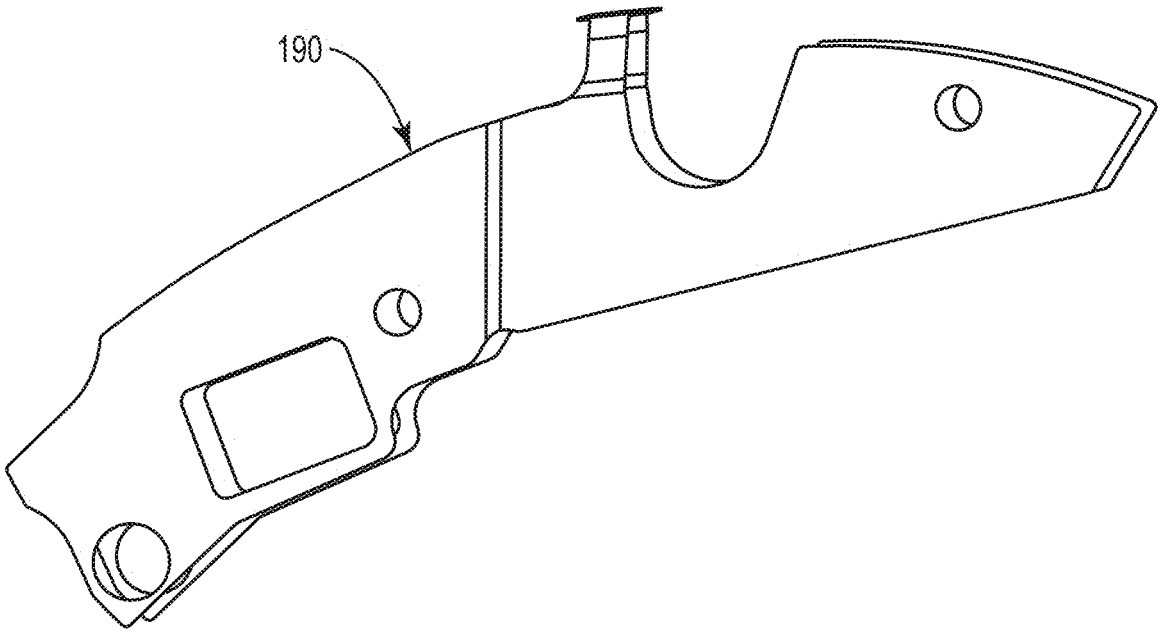

FIG. 2B shows one example of the antenna 190, which may contain two elements. Each of the two elements may be substantially planar and elongate along a length of the hearing aid. One antenna element may be disposed on a left side of the hearing aid, and the other antenna element may be disposed on a right side of the hearing aid.

Figure 3:
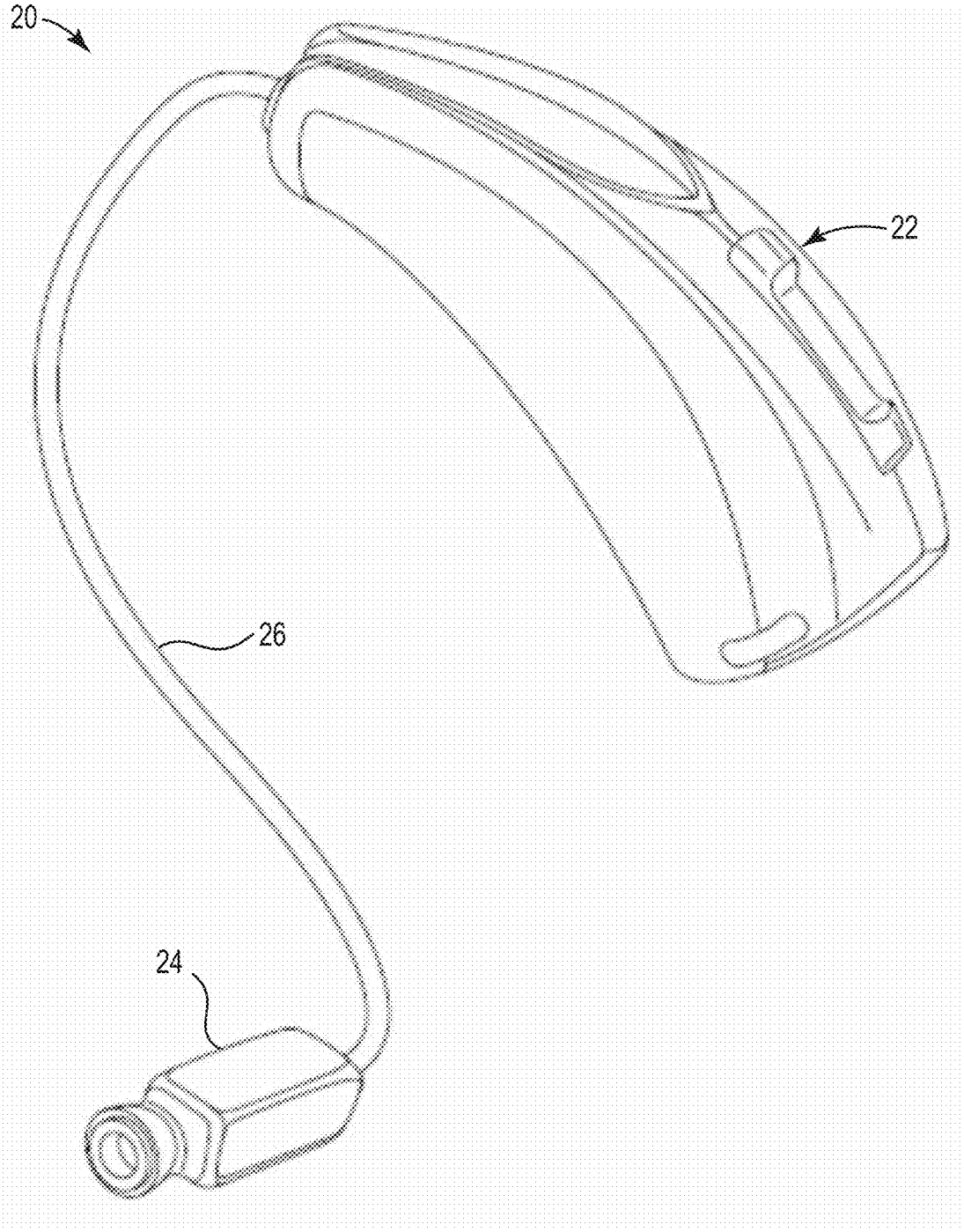
FIG. 3 is a perspective illustration of an ear-worn device according to various embodiments of the present disclosure.
Figure 4:
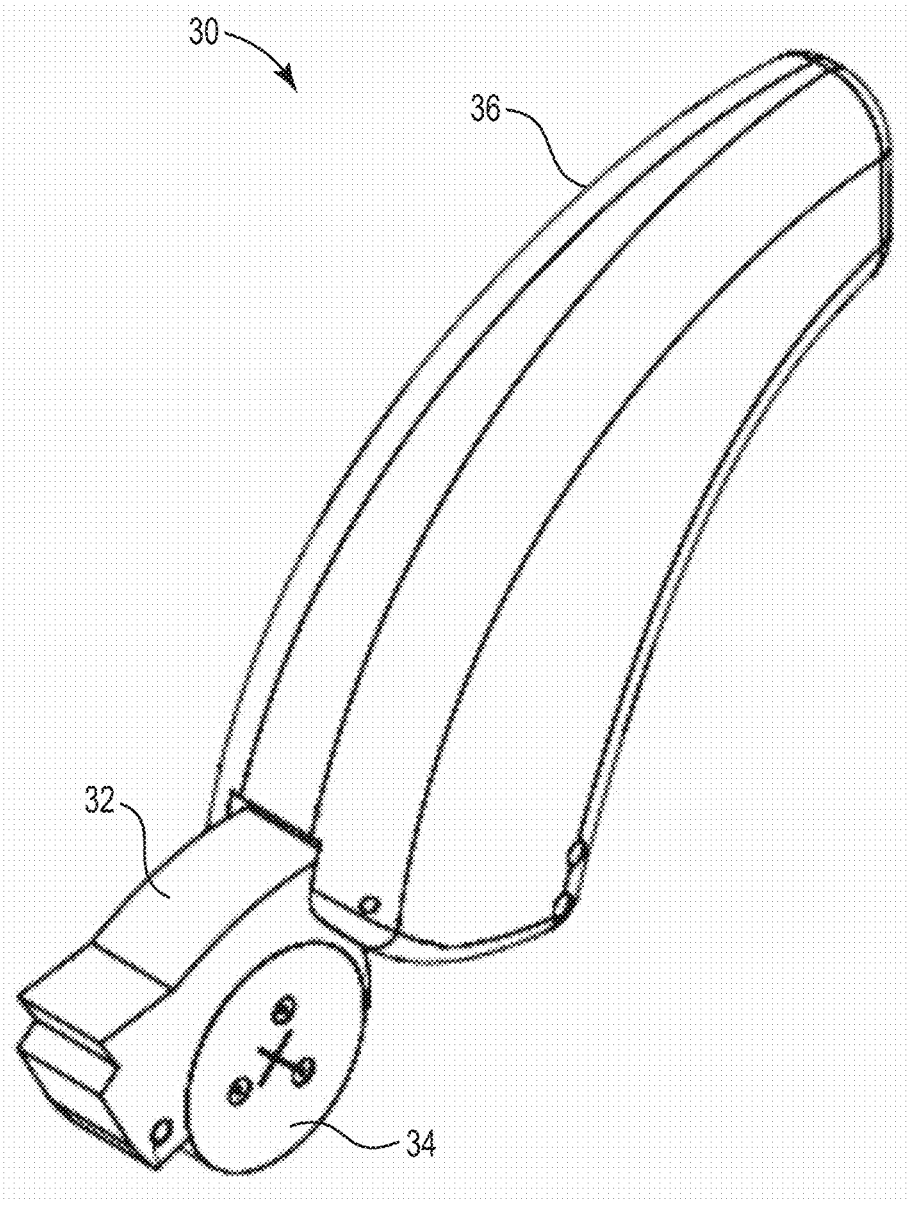
FIG. 4 is a perspective illustration of an ear-worn device having a battery door according to various embodiments of the present disclosure.
Figure 5A:
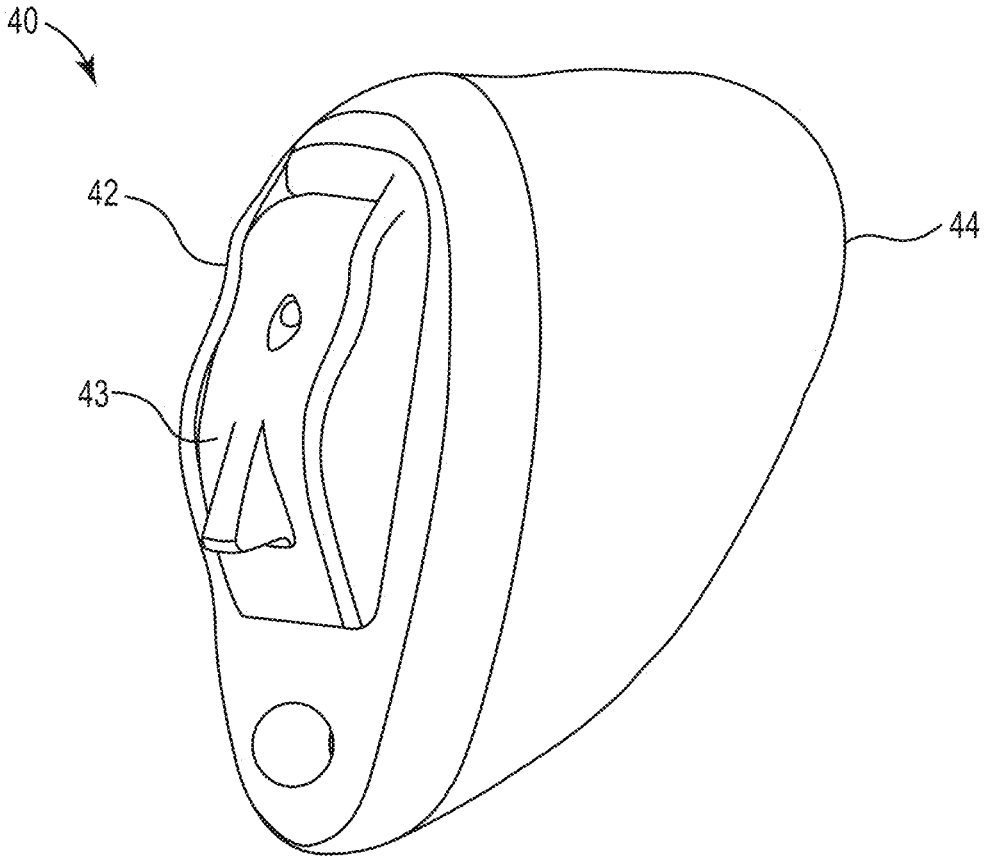
FIGS. 5A-C are perspective illustrations of faceplates according to various embodiments of the present disclosure.
Figure 5B:
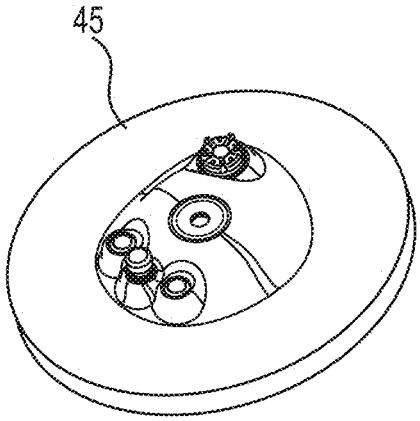
Figure 5C:
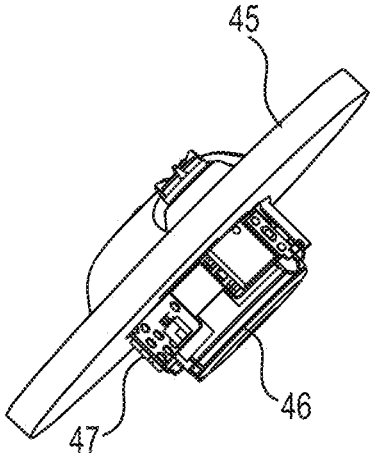
Figure 6:
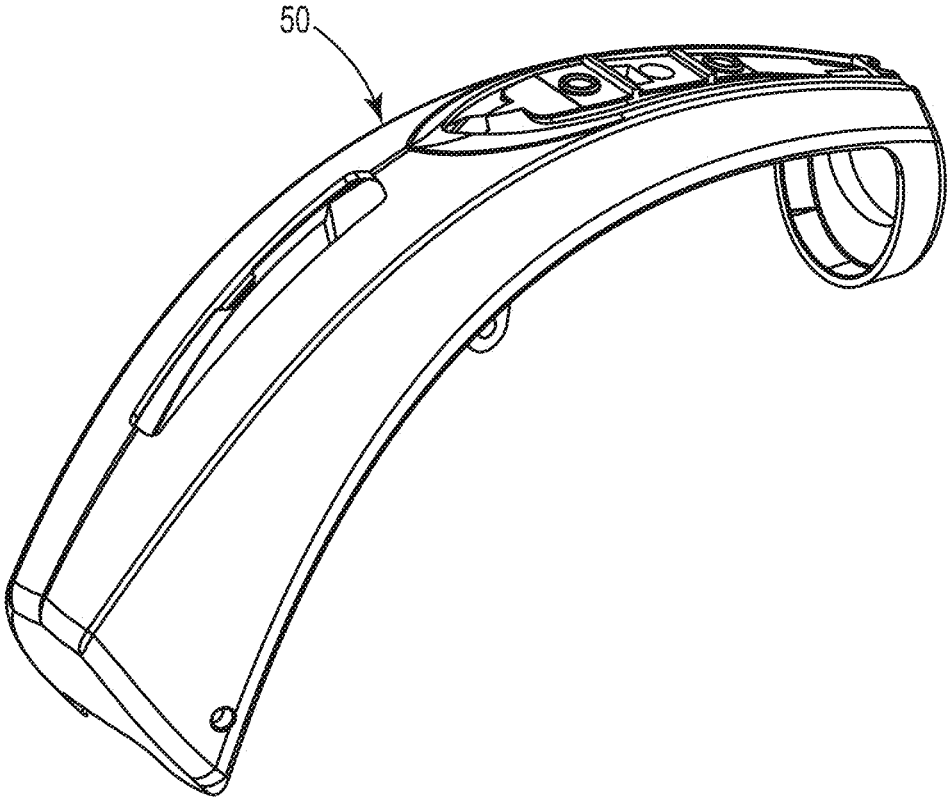
FIG. 6 is a perspective illustration of a top case according to various embodiments of the present disclosure.
Figure 7:
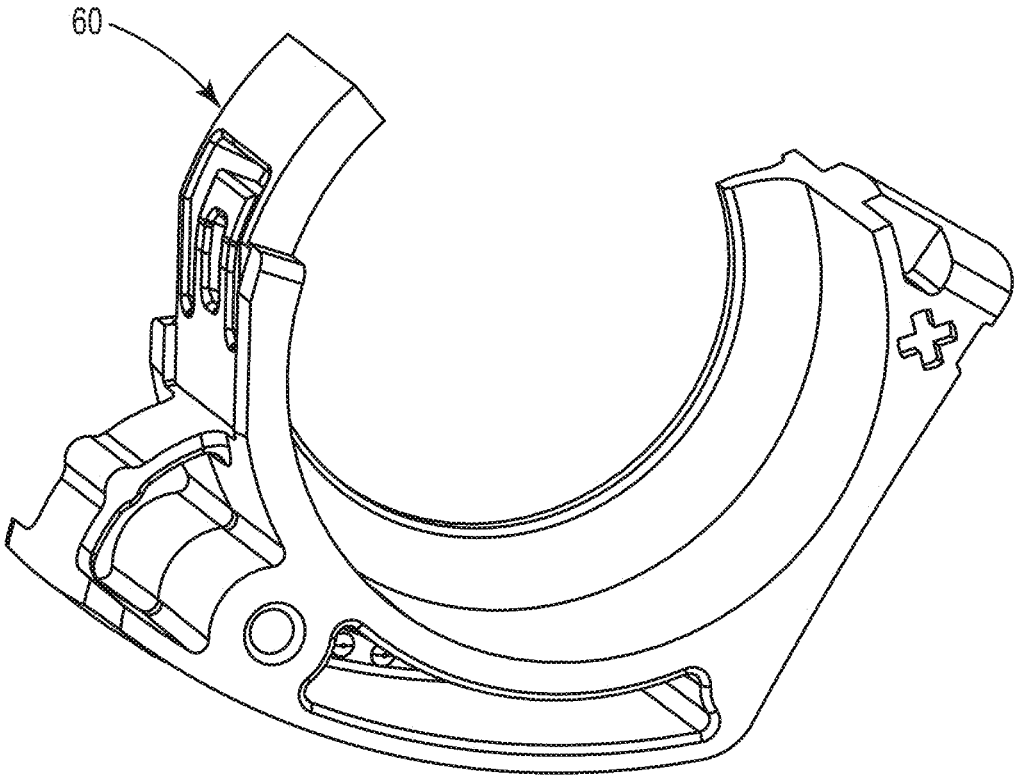
FIG. 7 is a perspective illustration of a battery door according to various embodiments of the present disclosure.
Figure 8:
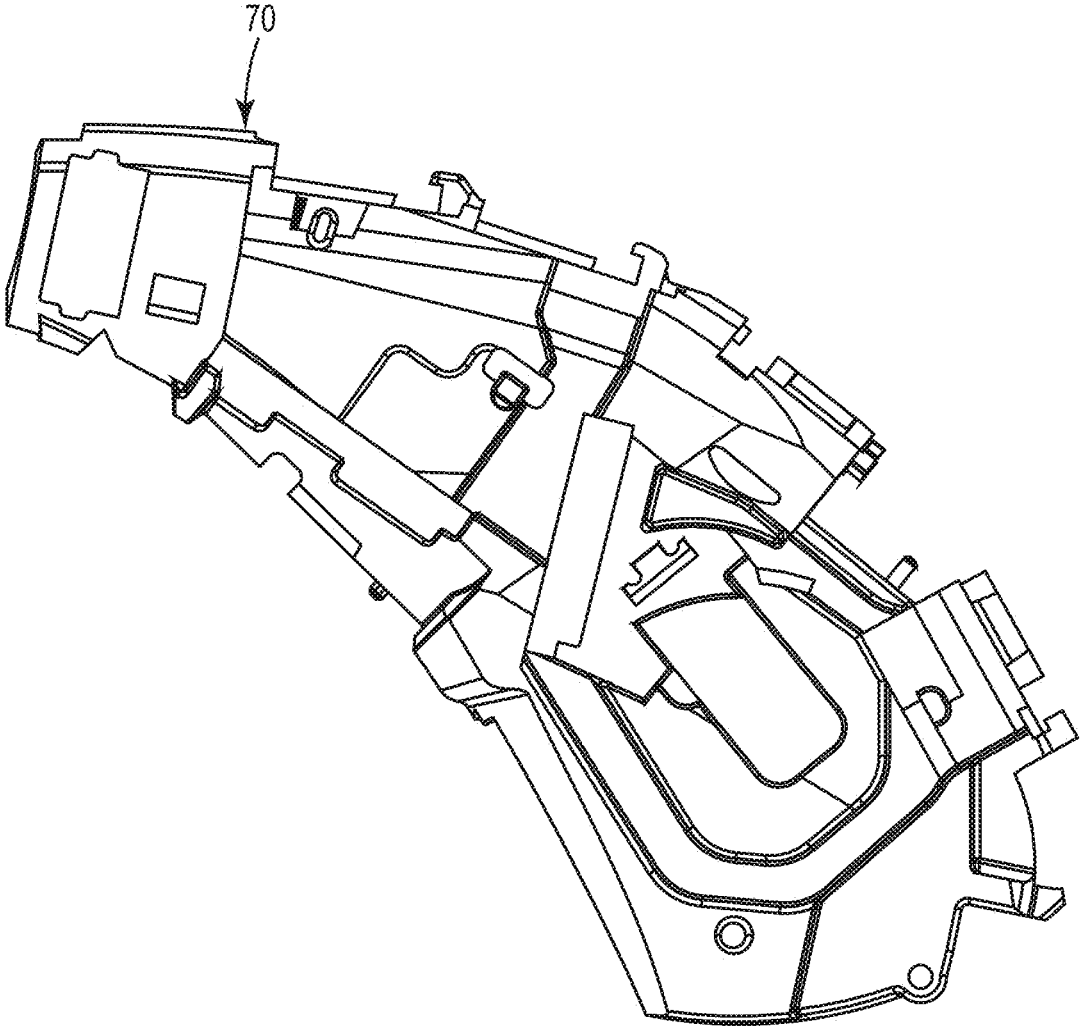
FIG. 8 is a perspective illustration of a frame according to various embodiments of the present disclosure.

FIGS. 3-8 show various components of ear-worn devices, particularly hearing aids, that may be formed as, or may be formed to include, a structural element made of a high-dielectric material. Using a high-dielectric material for one or more structural elements may eliminate the need for using a specialized substrate to increase electrical antenna length. The selection of components to form as structural elements may be determined based on the electric and/or magnetic field distribution generated by the ear-worn device, for example, from the antenna, based on the type of wireless communication being used (e.g., orthogonal waves or creeping waves), and the type of ear-worn device (e.g., RIC or ITE). FIG. 3 shows one example of a RIC hearing aid as ear-worn device 20. FIG. 4 shows one example of a hearing aid with a battery door 32 as ear-worn device 30. FIGS. 5A-C show examples of faceplates 42 and 45 that may be used in an ear-worn device, particularly a custom product. FIG. 6 shows one example of a top case 50 that may be used in an ear-worn device. FIG. 7 shows one example of a battery door 60 in isolation that may be used in an ear-worn device. FIG. 8 shows one example of a frame 70, or spine, in particular a flex spine, that may be used in an ear-worn device. Other components of ear-worn devices not shown in FIGS. 3-8 may also include a structural element made of a high-dielectric material.

Referring to FIG. 3, in one example, ear-worn device 20 may be a RIC hearing aid including three components, which are as illustrated, an on-ear module 22 incorporating a battery pack designed to be worn on or behind the ear, an in-ear module 24 designed to be worn in the ear canal, and a cable 26 with connectors for connecting the in-ear module to the on-ear module. One or more of these components may include a structural element made of a high-dielectric material.

The battery pack of the on-ear module 22 may or may not be patient-changeable and may contain batteries of any chemistry (e.g., rechargeable or not rechargeable). In some embodiments, a combination of rechargeable batteries and a primary, or replaceable, battery may be used.

The on-ear module 22 may also contain power management circuitry, telecoil, wireless transceiver, and an antenna (or a portion thereof) (see FIG. 2). In one embodiment, the on-ear module 22 also includes a charging antenna (inductive or RF) for wirelessly recharging one or more batteries 120 and/or includes photo-voltaic cells on its surface for battery recharging. The cable connector of the on-ear module may be a self-aligning magnetic design. The wireless transceiver 180 may be capable of operating in different frequency bands so that different battery packs operate in a frequency band that has radio regulatory compliance with the country intended for sale. For example, the wireless transceiver may operate in the 900 MHz or 2.4 GHz RF bands or may be an NFMI transceiver with NFMI coil. In one embodiment, the wireless transceiver and antennas may be designed for both NFMI and RF operation. In still another embodiment, two antennas may be incorporated and or two receivers for both NFMI and long-range RF communication.

The on-ear module 22 may contain any or all the following components: processing circuitry 101, one or more microphones 105, speaker 160, and wireless transceiver 180. The canal module, or in-ear module 24, may also incorporate features for venting and/or wax protection. In some embodiments, the in-ear module 24 may also incorporate a telecoil, an RF Antenna (or a portion thereof) and or an NFMI coil (e.g., for audio streaming).

The cable 26 connects to the on-ear module 22 via a first cable connector and connects to the in-ear module 24 via a second cable connector. The cable 26 could also be molded into the housing of the on-ear module or fixed to the housing as without a separate connector. The cable 26 may also contain elements of the antenna 190 and/or contain a transmission feed line for transporting RF energy between the wireless transceiver 180 and antenna 190.

FIG. 4 shows ear-worn device 30 in the form of a hearing aid with battery door 32, which may be used to removably retain battery 34 within ear-worn device 30. Battery door 32 may be hinged to a frame (not shown), and may be included as part of housing 36, of the ear-worn device 30. One or more of battery door 32, housing 36, or even the hinge may include, or be, a structural element made of a high-dielectric material. Thus, in some examples, a battery of ear-worn device 30 may be configured to be retained by battery door 32 of ear-worn device 30.

Some ear-worn devices my include a structural element that defines at least part of an outer surface of a housing of the ear-worn device. In some embodiments, the structural element may form, or be part of, a top case, a bottom case, a faceplate, a battery enclosure, or a shell. A bottom case may also be described as a shell case. A top case and a bottom case may at least partially form a housing of, for example, a hearing aid.

FIG. 5A shows ear-worn device 40, which may be made custom to fit a particular wearer. In the illustrated embodiment, ear-worn device 40 includes faceplate 42, battery enclosure 43 (for example, a battery door), disposed in an opening of the faceplate, and shell 44 coupled to the faceplate. Faceplate 42, battery enclosure 43, and shell 44 may at least partially form a housing of, for example, a hearing aid. A battery (not shown) may be at least partially enclosed by battery enclosure 43. Battery enclosure 43 may be hingedly coupled to faceplate 42, for example, to allow replacement of the battery. A frame (not shown), which may also be referred to as a spine, may be disposed within a volume formed within faceplate 42 and shell 44. For instance, a structural element may comprise a faceplate (e.g., faceplate 42 that, together with the shell (e.g., shell 44) of the ear-worn device (e.g., ear-worn device 40), defines a volume within which a spine of the ear-worn device is disposed. The frame may be coupled to faceplate 42, shell 44, or both. One or more of faceplate 42, battery enclosure 43, shell 44, and the frame may include, or be, a structural element made of a high-dielectric material.

FIGS. 5B-C show a different faceplate 45, which may also be made custom to fit a particular wearer. Faceplate 45 may couple to a shell, for example, similar to shell 44. For example, faceplate 45 may be connected to one end of a shell, and may be included as part of a housing, of a hearing aid. In the illustrated embodiment, battery 46 and printed circuit board 47 may be coupled to faceplate 45. Faceplate 45 may include, or be, a structural element made of a high-dielectric material.

In one or more embodiments, faceplate 42 or 45 includes a status indicator light (not shown), a microphone inlet port, or both. A shell, such as shell 44, may include a speaker outlet port. Faceplate 42 or 45 can also include a vent port that is in fluid communication with the inlet of a hearing aid vent. In one or more embodiments, faceplate 42 or 45 can include the same material or materials utilized to form at least one of a shell and a frame.

FIG. 6 shows top case 50, which may be included as part of a housing, of a hearing aid. Top case 50 may include, or be, a structural element made of a high-dielectric material. Top cases 50 with high-dielectric structural elements may be used, for example, in some custom or standard-design hearing aids. Top case 50 may at least partially cover internal electronic components of a hearing aid, such as the battery and antenna. Thus, top case 50 may at least partially cover internal electronic components of an ear-wearable device. Top case 50 may form a superior portion of a shell of ear-worn device. One or more initially separate components may be directly or indirectly attached to top case 50 to form the shell of the ear-worn device. Thus, an ear-worn device may be assembled in part by attaching top case 50 to one or more other shell components to form a cavity that contains the antenna and other internal electronic components of the ear-worn device.

In one example consistent with the example of FIG. 6, an ear-worn device may comprise an antenna comprising a conductive material configured to provide an electric field in response to a driving signal. In this example, the antenna includes a first antenna element, a second antenna element, and an antenna feed point. The antenna feed point is coupled to the first antenna element and the second antenna element and configured to provide the driving signal. Each of the first antenna element and the second antenna element is formed of the conductive material and is configured to provide the electric field in response to the driving signal from the feed point. The ear-worn device may also comprise internal electronic components. In this example, the ear-worn device comprises a housing (e.g., of which top case 50 may be a part) that at least partially covers the internal electronic components of the ear-worn device. The housing includes comprises a host resin material. A plurality of dielectric material elements having a dielectric constant greater than the host resin material dispersed in the host resin material.

FIG. 7 shows battery door 60, which may be similar to battery door 32 (FIG. 4). Battery door 60 may include, or be, a structural element made of a high-dielectric material. Battery door 60 may at least partially cover internal electronic components of a hearing aid, such as the battery, which may be nested in the battery door.

Some ear-worn devices may include a structural element contained within a housing of the ear-worn device. In some embodiments, the structural element may form, or be part, for example, a frame or spine.

FIG. 8 shows frame 70, which may be used to support various electronics and may be included as part of a housing of a hearing aid. Frame 70 may include, or be, a structural element made of a high-dielectric material. Frame 70 may also be described as a spine. The use of a spine in a hearing aid is described, for example, in U.S. application Ser. No. 15/429,898, filed Feb. 10, 2017, published as U.S. Patent Publication No. 2018/0234781, which is incorporated herein in its entirety. Frame 70 is a structure that holds operative components of an ear-worn device at specific positions and orientations. In other words, one or more hearing assistance components can be disposed on the frame 70. Frame 70 may fit within a shell of the ear-worn device or form part of the shell of the ear-worn device. In some examples, frame 70 may take a shape such that frame 70 conforms to at least a portion of an inner surface of the shell of the ear-worn device. Frame 70 can include any suitable material or materials, e.g., polymeric, metallic, or inorganic materials, and combinations thereof. In one or more examples, frame 70 can include at least one of photopolymers, fused deposition modelling (FDM) materials, cast urethanes, cast epoxies, nylons, polyethylene, acrylonitrile butadiene styrene (ABS), and ceramics.

FIGS. 9-19 show various embodiments of antenna structures including an antenna and a high-dielectric structural element. In general, each structural element described herein may be part of a housing or other component of a hearing aid that mechanically supports a rigid or semi-rigid form of the hearing aid.

Figure 9:
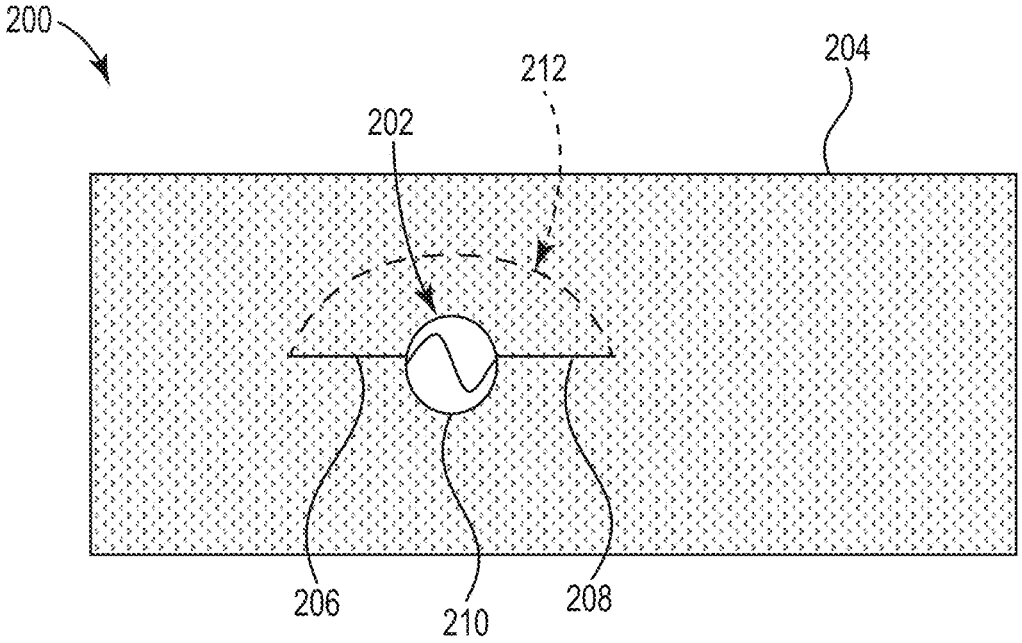
FIG. 9 is a schematic illustration of an antenna structure including an antenna and structural element according to various embodiments of the present disclosure.

Referring first to FIG. 9, antenna structure 200 is illustrated including antenna 202 and structural element 204. Antenna 202 includes first antenna element 206, second antenna element 208, and antenna feed point 210, or antenna source, coupled to the first and second antenna elements. Antenna 202 may be described as a dipole antenna disposed on structural element 204. Each antenna element 206, 208 may be formed of a conductive material. Antenna 202 may define a nominal antenna wavelength corresponding to a physical antenna length.

Antenna 202 may be attached to, in proximity to, or embedded in structural element 204. The electrical field generated by antenna 202 may be concentrated in high-dielectric structural element 204 when positioned near antenna 202. The presence of structural element 204 may result in an effective antenna wavelength of antenna 202 that is longer than the nominal antenna wavelength.

Figure 11:
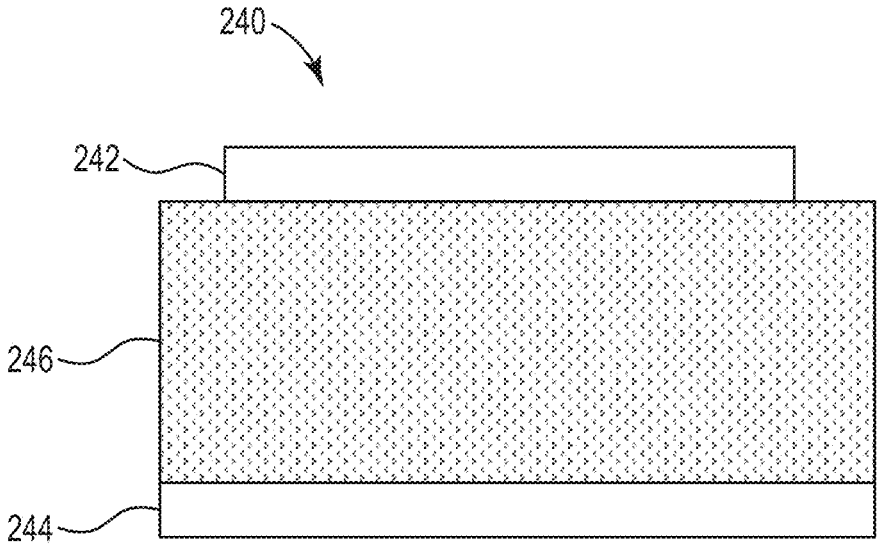
FIG. 11 is a schematic illustration of an antenna structure including a patch antenna and a structural element according to various embodiments of the present disclosure.

In some embodiments, reducing the length of antenna 202 may be useful, for example, to save space in a hearing aid. The length of antenna 202 (d) may be selected based on the electrical permittivity (ε) of the material used to form structural element 204 and a desired electrical length ($d_{eff}$), for example, according to Equation 1. In other words, the length of antenna 202 may be, equal to, or proportional to, the length antenna 202 would be without a nearby high-dielectric material between first and second antenna elements 242, 244 (FIG. 11). In general, $d_1$ may be shorter than $d_2$ due to the presence of the nearby high-dielectric material.

$$d=d_{eff}/\sqrt{\varepsilon} \quad (1)$$

While reference is made herein to dipole antennas, the structural elements of the present disclosure may be used with any suitable antenna structure. For example, the structural elements of the present disclosure may be used with a monopole antenna, an inverted-F antenna, a planar inverted-F antenna (PIFA) (such as a meandered PIFA or non-meandered PIFA), a patch antenna, or other types of antenna. Furthermore, in some examples, an ear-worn device may include an antenna array having two or more antennas or antenna elements (see, e.g., FIGS. 20A-B). The antenna array may be a phased antenna array. Each antenna element may be formed of a conductive material configured to provide an electric field in response to a driving signal (e.g., from a feed point). A structural element may be positioned between at least two of the antennas or antenna elements. Sizes of the two or more antennas or antenna elements may be selected based on an effective dielectric constant of the structural element. In some embodiments, the antennas or antenna elements are spaced between 0.25 to 1.5 times a nominal antenna wavelength.

Figure 10:
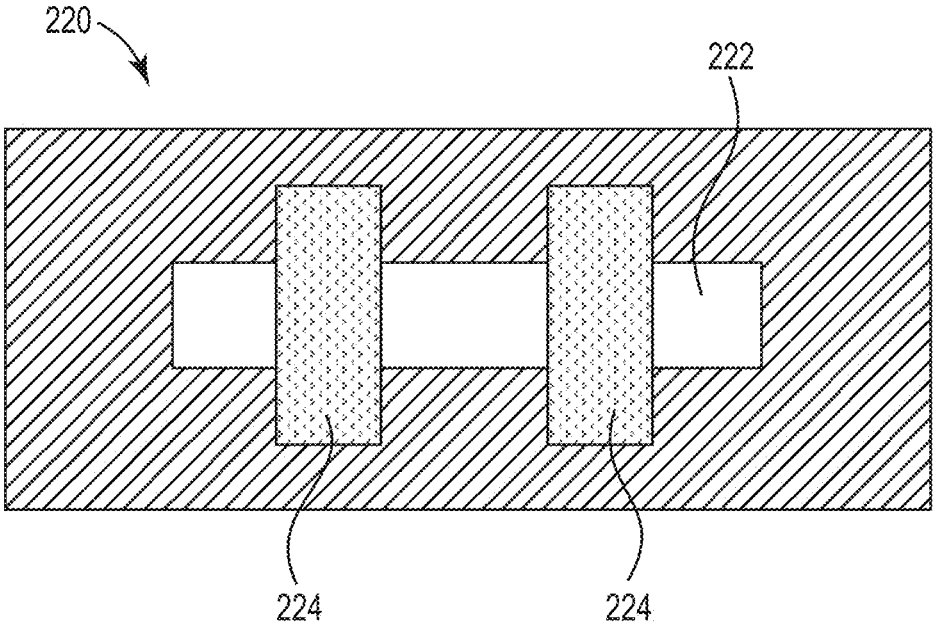
FIG. 10 is a schematic illustration of an antenna structure including a slot antenna and structural elements according to various embodiments of the present disclosure.

FIG. 10 shows antenna structure 220 including slot antenna 222 and structural elements 224. The size and positioning of structural elements 224 relative to slot antenna 222 may be used to input different modes. Slot antenna 222 may include an elongate slot. One or more structural elements 224 may extend laterally across a width of the elongate slot. As illustrated, antenna structure 220 may be described as a half-wavelength type of slot antenna.

Slot antenna 222 may be describe as being, or including, a conductor. The conductor may be metal, such as a metal sheet with a slot (e.g., free space extending through the conductor) formed inside. The slot formed in the conductor may define a length and a width shorter than the length. One or more structural elements 224 may embedded in, disposed on, or disposed proximate to, slot antenna 222. Some structural elements 224 may be coupled to slot antenna 222. In the illustrated embodiment, structural elements 224 are positioned across the width of the slot.

As illustrated, structural elements 224 may not extend along the entire length of an antenna, such as slot antenna 222. In some embodiments, structural elements 224 are positioned along only a selected portion of antennas to increase the electric field strength, proportional to the effective dielectric constant of the structural elements, in a region proximate to the selected portion of the antenna. The selected portion of the antenna may be an emitting region of the antenna, which may have a higher current than other regions of the antenna.

In some embodiments, structural elements may be positioned between conductors of an antenna, such as antenna elements that correspond to high electric-field distribution.

FIG. 11 shows antenna structure 240 including first antenna element 242, second antenna element 244, and structural element 246 between first and second antenna elements. Structural element 246 may be coupled to one or both antenna elements 242, 244 to maintain a distance between them. In some embodiments, structural element 246 may be described as being, or being part of, a spine of a hearing aid.

Antenna structure 240 may be described as being, or being part of, a patch antenna. A patch antenna may be used, for example, for a hearing aid inserted into a user's ear. The antenna structure 240 may represent, for example, a cross-section of a faceplate, such as faceplate 42 (FIG. 5A). First antenna element 242 may be described as a patch conductor, or conductive patch element. Second antenna element 244 may be described as a ground conductor, or ground plane element. First and second antenna elements 242, 244 may be planar conductors. For example, one or both antenna elements may be formed of metal, such as copper. In some embodiments, each antenna element 242, 244 may be disposed on a different side (e.g., left or right side) of a hearing aid, such as the two components of frame 70 (FIG. 8).

As illustrated, the entire width of structural element 246 is formed of high-dielectric material. In other embodiments, only a portion or some portions of structural element 246 is formed of high-dielectric material. Other portions may be formed, for example, of the host resin without the dielectric material elements. In some embodiments, only a portion of the width of structural element 246 may overlap with first antenna element 242. The width of structural element 246 may be the same as second antenna element 244 (e.g., as illustrated) or different. The width of the overlap ($W_{doped}$) may be, equal to, or proportional to, the width of first antenna element 242 if only air is present ($W_{air}$) between first and second antenna elements 242, 244 divided by the square root of the electrical permittivity ($\sqrt{\varepsilon}$), for example, according to Equation 2. In general, $W_{doped}$ may be shorter than $W_{air}$ due to the presence of the high-dielectric material between first and second antenna elements 242, 244.

$$W_{doped}=W_{air}/\sqrt{\varepsilon} \quad (2)$$

Figure 12:
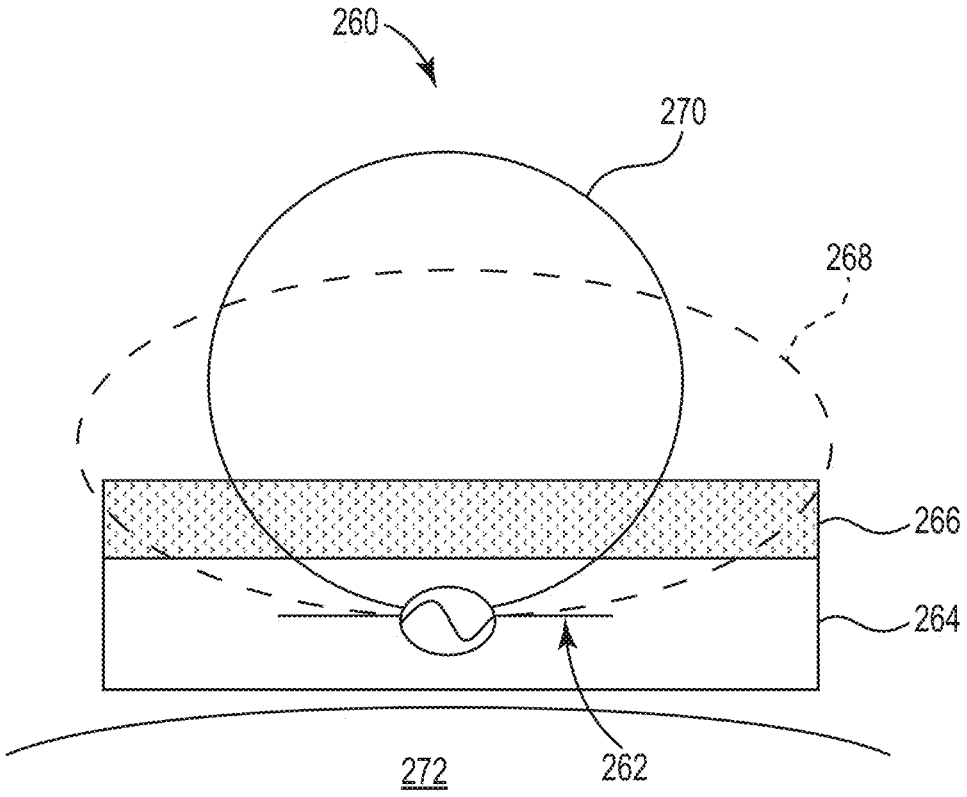
FIG. 12 is a schematic illustration of an antenna structure including an antenna between a structural element and a wearer according to various embodiments of the present disclosure.

FIG. 12 shows antenna structure 260 including antenna 262 (e.g., dipole antenna), housing part 264, and structural element 266. Antenna 262 may be coupled to a printed circuit board (not shown), for example, disposed on the surface or embedded therein. Housing part 264 may represent all, or part of, a housing of a hearing aid. Structural element 266 may be embedded in (e.g., integral to, contained within) housing part 264, disposed on housing part 264, or disposed proximate to housing part 264. Antenna 262 may be disposed in housing part 264. In some embodiments, structural element 266 may be disposed on the housing of the hearing aid. In some embodiments, structural element 266 and housing part 264 may each form a different part of the housing of the hearing aid.

In some embodiments, structural element 266 does not interface with a user's skin when the ear-worn device is worn to concentrate the electric field away from the user. For example, structural element 266 may be positioned proximate to a first side of antenna 262 opposite to a second side of the antenna that is positioned proximate to a wearer of the ear-worn device to redirect the electric field into a directional pattern away from the wearer.

To demonstrate the effect of including structural element 266, a schematic illustration of first electric field 268 and second electric field 270 are shown. First electric field 268 may represent the electric field pattern generated without the presence of structural element 266, whereas second electric field 270 may represent the electric field pattern generated when structural element 266 is included. In general, second electric field 270 may be narrower than first electric field 268 with reference to a propagation direction orthogonal to the length of antenna 262. When antenna structure 260 is used for wireless communication and is adjacent to, or proximate to, user's body 272, the resulting narrower second electric field 270 may provide improved communication (e.g., less losses) over a wider first electric field 268 resulting from not using structural element 266.

Figure 13:
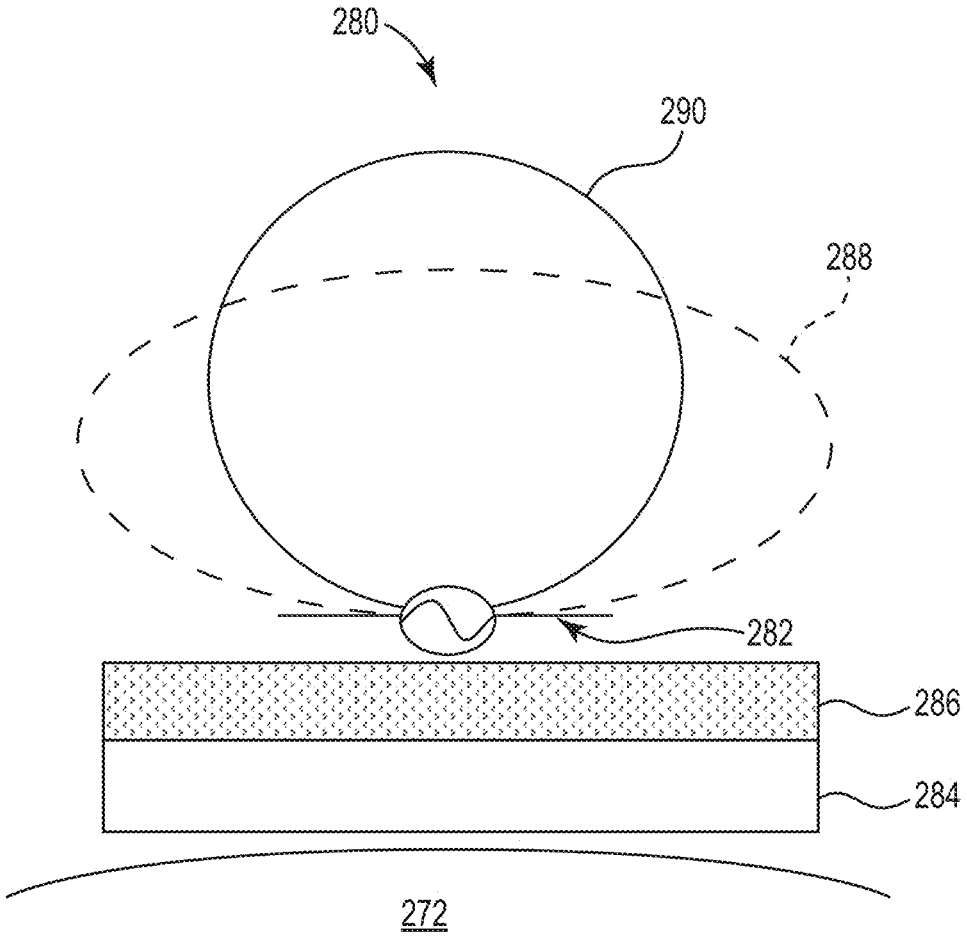
FIG. 13 is a schematic illustration of an antenna structure including a structural element between an antenna and a reflector according to various embodiments of the present disclosure.

FIG. 13 shows antenna structure 280 including antenna 282 (e.g., dipole antenna), housing part 284, and structural element 286. Antenna 282 may be coupled to a printed circuit board (not shown), for example, disposed on the surface or embedded therein. Antenna structure 280 is similar to antenna structure 260, and similar parts have similar numbering. Antenna structure 280 differs from antenna structure 260 in that antenna 282 is positioned outside of housing part 284. Using antenna structure 280 may result in the schematic representation of second electric field 290, whereas first electric field 288 schematically represents the electric field pattern generated without the presence of structural element 286. Similar to antenna structure 260, second electric field 290 is narrower than first electric field 288, which may be used when antenna structure 280 is positioned adjacent to, or proximate to, user's body 272.

In some embodiments, increasing the distance between antenna 282 and housing part 284 may be useful, for example, to reduce losses from user's body 272. Structural element 286 may facilitate an increased effective distance ($d_{eff}$) between housing part 284 and antenna 282 without increasing the physical distance between housing part 284 and antenna 282. For example, in some embodiments, when structural element 286 is disposed between housing part 284 and antenna 282, the depth (d), or thickness, of structural element 286 may be selected based on the electrical permittivity (ε) of the material used to form structural element 286, for example, according to Equation 3. In general, d may be smaller than $d_{eff}$ due to the presence of high-dielectric structural element 286. In some embodiments, the $d_{eff}$ may be equal to a quarter-wavelength of the wavelength of antenna 282.

$$d=d_{eff}/\sqrt{\varepsilon} \quad (3)$$

In some embodiments, housing part 284 may be described as being, or include, a reflector for reflecting, or scattering, radio waves. The reflector may also be described as a ground plane. The reflector may be flat, or substantially flat, and may be substantially larger in area than antenna 282.

Some structural elements may be used to enhance a surface wave or a creeping wave. In some embodiments, ear-worn devices may launch surface or creeping waves along a head of the wearer for wireless communication with another ear-worn device (e.g., worn on the other ear).

Figure 14:
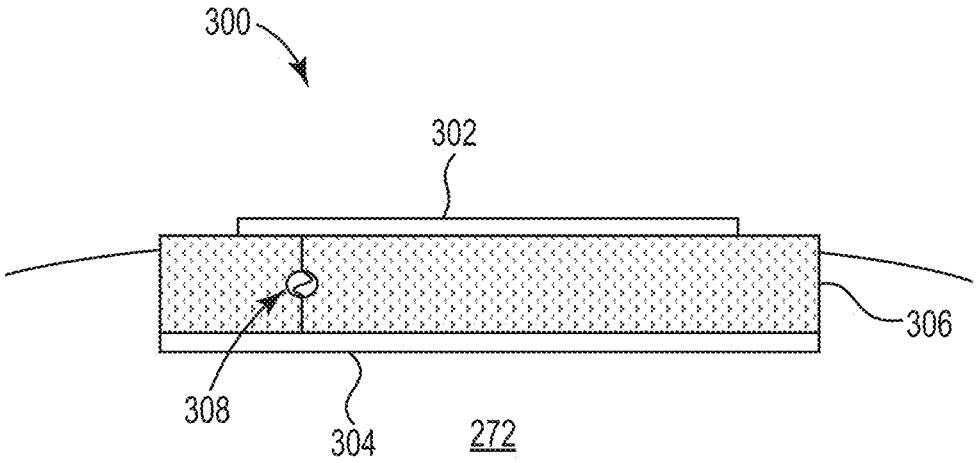
FIG. 14 is a schematic illustration of an antenna structure in a recess for launching creeping or surface waves along an interface between a wearer and the ambient environment according to various embodiments of the present disclosure.

FIG. 14 shows antenna structure 300 including first antenna element 302, second antenna element 304, and structural element 306 between first and second antenna elements. Antenna structure 300 may be used to launch creeping waves along an interface between an object, such as user's body 272, and the ambient environment, or air. For example, antenna structure 300 may be used in a hearing aid inserted into the user's ear for ear-to-ear wireless communication. In some embodiments, an outer surface of antenna structure 300 may be flush with a surface of user's body 272 (e.g., to form one plane for launching creeping waves). In some embodiments, one or both antenna elements 302, 304 and structural element 306 may be positioned in a recess of an outer surface of a housing of an ear-worn device. As illustrated, first antenna element 302 and second antenna element 304 form a patch antenna. However, any suitable antenna type may be used, for example, to launch creeping waves. In some embodiments, antenna structure 300 may be described as being, or being part of, a faceplate of a hearing aid.

Antenna structure 300 is similar to antenna structure 240 (FIG. 11), and similar parts have similar numbering. Antenna structure 300 differs from antenna structure 240 in that antenna structure 300 includes antenna 308. Antenna 308 is coupled between first antenna element 302 and second antenna element 304. Antenna 308 may be embedded in, disposed adjacent to, or disposed proximate to structural element 306. As illustrated, antenna 308 may include components similar to a dipole antenna (e.g., two elements and an antenna feed point).

Figure 15:
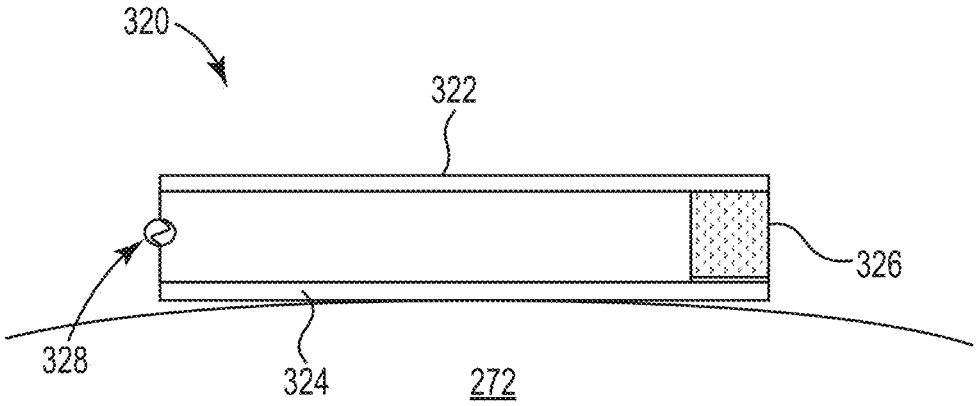
FIG. 15 is a schematic illustration of an antenna structure for launching creeping or surface waves along an interface between a wearer and the ambient environment according to various embodiments of the present disclosure.

FIG. 15 shows antenna structure 320 including first antenna element 322, second antenna element 324, and structural element 326 between first and second antenna elements. Antenna structure 320 may also be used to launch creeping waves along an interface between an object, such as user's body 272, and the air. However, antenna structure 320 may be disposed on user's body 272, as opposed to being inserted. In other words, an inner surface of antenna structure 320 may interface with, or be coupled to, a surface of user's body 272 to launch creeping waves.

Antenna structure 320 is similar to antenna structure 300 (FIG. 14), and similar parts have similar numbering. Antenna structure 320 differs from antenna structure 300 in that structural element 326 has a width that does not extend along the entire width of first antenna element 322 or the entire width of second antenna element 324. Thus, in the example of FIG. 15, the part of structural element 326 that is positioned between first antenna element 322 and second antenna element 324 does not extend along an entire width of first antenna element 322 or an entire width of second antenna element 324. Antenna structure 320 also differs from antenna structure 300 in that feed point 328 may be spaced from structural element 326. For example, feed point 328 may be described as being laterally spaced, in a direction long to the length of first antenna element 322 or second antenna element 324. In other words, feed point 328 may not be embedded in, disposed adjacent to, or disposed proximate to structural element 326.

In some embodiments, antenna structure 320 may be described as being part of a housing of a hearing aid. In particular, structural element 326 may be described as being part of the housing. In some embodiments, only a portion of the housing may be formed with high-dielectric structural element 326, which may facilitate directionally launching creeping waves from feed point 328 toward structural element 326 along the interface between user's body 272 and the air. For example, structural element 326 may be formed, for example, of a host resin with dielectric elements, while other portions of the housing may be formed, for example, of a host resin without dielectric elements. Thus, in some examples, one or more parts of the housing of the ear-worn device other than the part of the structural element that is positioned between a first antenna element (e.g., first antenna element 322) and a second antenna element (e.g., second antenna element 324) may comprise the host resin material without any dielectric material elements having the dielectric constant greater than the host resin material.

In various embodiments, structural element 326 of antenna structure 320 is configured to excite electric field components in a direction perpendicular to an outer surface of the housing of the ear-worn device. For example, electric field components may be excited in a direction from feed point 328 toward structural element 326 when structural element 326 is part of the housing of the ear-worn device. Antenna structure 320 may be disposed on and protrude from structural element 326.

Figure 16:
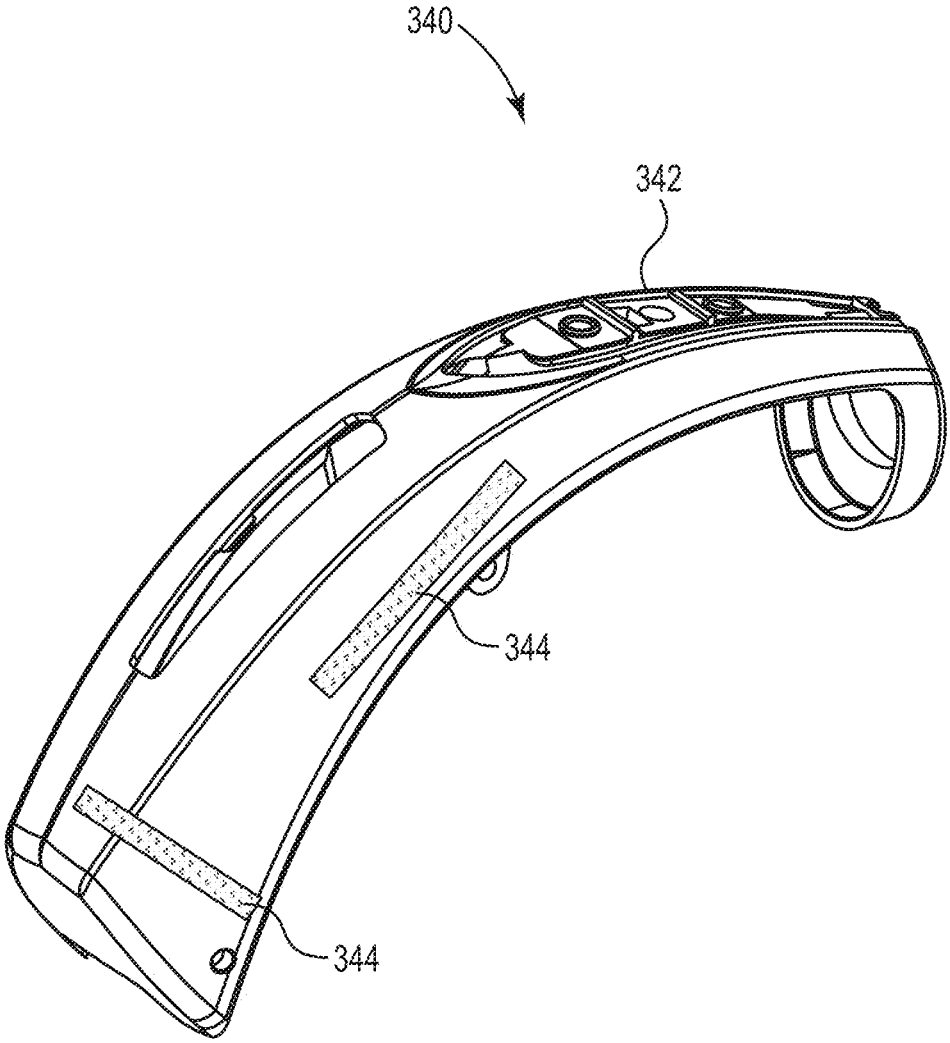
FIG. 16 is a perspective illustration of an ear-worn device including loading strips according to various embodiments of the present disclosure.

FIG. 16 shows ear-worn device 340 including top case 342 and one or more loading strips 344. Although loading strips 344 are illustrated schematically as rectangular elements, loading strips 344 may take any suitable shape. In particular, loading strips 344 may be contoured to be flush or almost flush with top case 342, for example, to facilitate aesthetics or comfort. Some or all of top case 342 may be formed of a high-dielectric material and described as a high-dielectric structural element. For example, some or all of top case 342 may be formed, for example, of a host resin with dielectric elements, while other portions of top case 342 may be formed, for example, of a host resin without dielectric elements.

Some or all of top case 342 including high-dielectric structural elements may be described as being, or being part of, a resonating structure. At least part of an electric field generated by an antenna of ear-worn device 340 may be redirected toward the structural elements in top case 342.

Ear-worn device 340 may include a spine, such as frame 70 (FIG. 8). Some or all of the spine may be formed of a high-dielectric material and described as a high-dielectric structural element. For example, some or all of the spine may be formed, for example, of a host resin with dielectric elements.

Ear-worn device 340 may include a faceplate, such as faceplate 42 (FIG. 5A). Some or all of the faceplate may be formed of a high-dielectric material and described as a high-dielectric structural element. For example, some or all of the faceplate may be formed, for example, of a host resin with dielectric elements.

In some embodiments, top case 342 and the spine include dielectric elements (e.g., include host resins doped with dielectric elements). In some embodiments, top case 342 and the faceplate include dielectric elements (e.g., include host resins doped with dielectric elements). The structural elements formed of high-dielectric material may be used to form part of a dielectric antenna for ear-worn device 340.

One or more loading strips 344 may be formed of a conductor. Loading strips 344 may be described as conductive strips. In general, each loading strip 344 may facilitate disruption of a mode of the dielectric antenna, which may allow electric field to escape for wireless communication. In other words, loading strips 344 may be positioned to tune the resonating structure of ear-worn device 340. In some embodiments, one or more loading strips 344 are coupled to an outer surface of structural elements that are part of top case 342.

Figure 17:
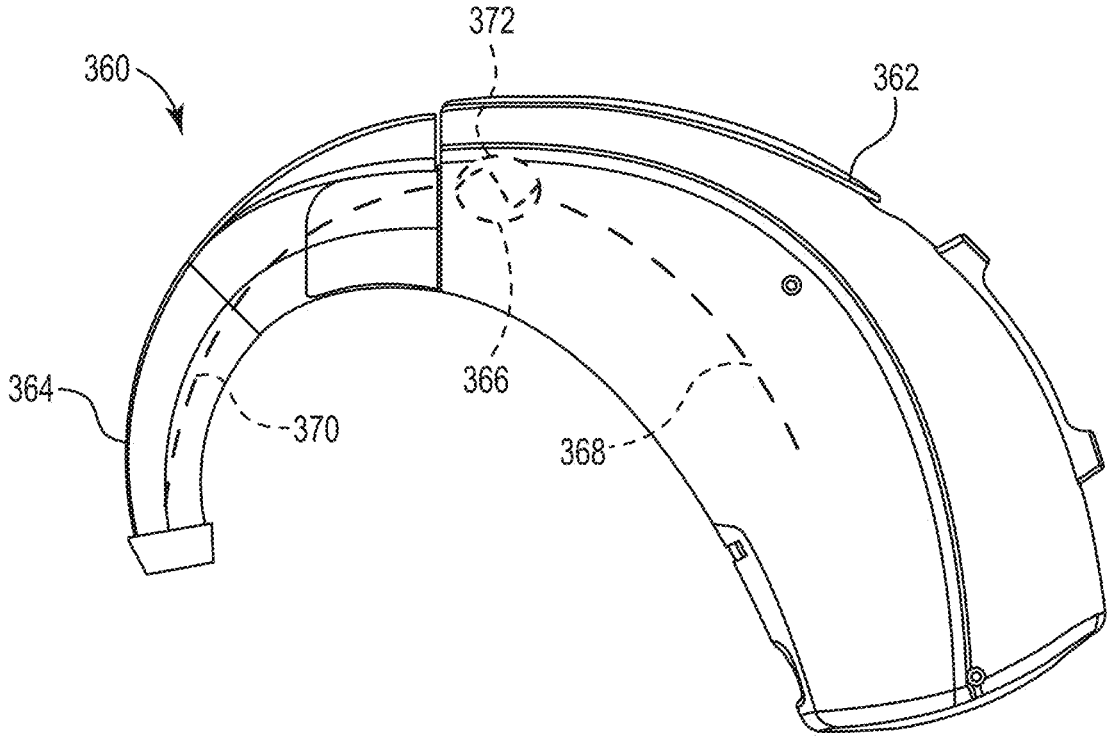
FIG. 17 is a schematic illustration of an ear-worn device having part of an antenna outside of a housing of the ear-worn device according to various embodiments of the present disclosure.

FIG. 17 shows ear-worn device 360 including first portion 362, second portion 364, and antenna 366. Ear-worn device 360 may be described as a RIC type of hearing aid. As illustrated, first portion 362 may be described as, or include, a housing of the hearing aid. First portion 362 may be, or include, a high-dielectric structural element. For example, the housing may be formed of high-dielectric material. Other structures not shown may also be formed of high-dielectric material, such as a faceplate, battery door, or frame. In some embodiments, first portion 362 may be worn behind a user's ear. In other embodiments (not shown), first portion 362 may be inserted into a user's ear.

Second portion 364 may be described as, or include, an ear hook for a BTE type of hearing aid. In other embodiments (not shown), second portion 364 may be a cable that may be inserted into a user's ear. In further embodiments (not shown), second portion 364 may be a handle (e.g., a handle used to remove an ear-worn device from a user's ear canal).

Antenna 366 may include first antenna element 368, second antenna element 370, and antenna feed point 372. Antenna 366 may be disposed at least partially within first portion 362 and at least partially within second portion 364. One or both antenna elements 368, 370 may be positioned external to a housing of ear-worn device 360, such as outside first portion 362. In the illustrated embodiment, first antenna element 368 and antenna feed point 372 may be disposed in first portion 362. Second antenna element 370 may be disposed in second portion 364. In some embodiments, first antenna element 368 may be a layer in a printed circuit board (PCB), such as a ground layer or ground plane.

Figure 18:
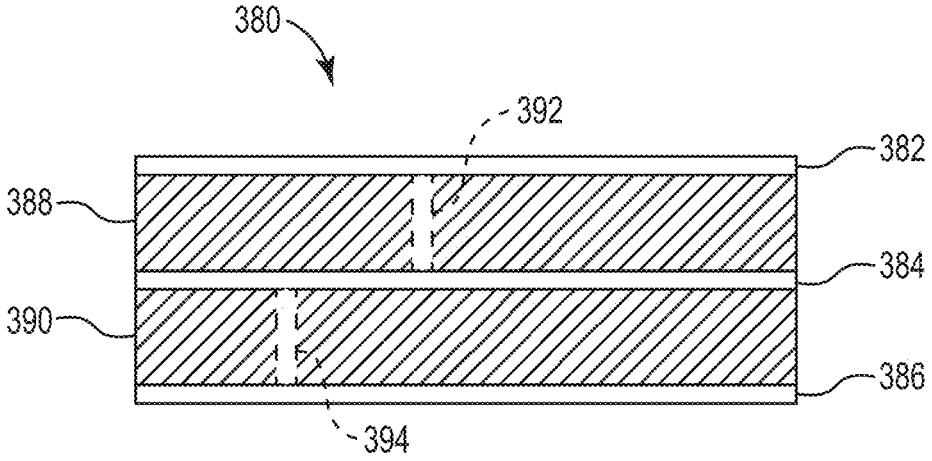
FIG. 18 is a schematic illustration of a printed circuit board for use in forming an antenna structure according to various embodiments of the present disclosure.

FIG. 18 shows printed circuit board 380 having multiple layers. In the illustrated embodiment, multi-layer PCB 380 includes conductive layers, such as first conductive layer 382, second conductive layer 384, and third conductive layer 386, and substrate layers, such as first substrate layer 388 and second substrate layer 390 (e.g., electrically insulating layers).

An antenna structure may be formed in PCB 380 as an embedded antenna, for example, using an etching process. The antenna structure may span one or more layers of the PCB 380, for example, using first conductive via 392 and second conductive via 394 that extend through one or more substrate layers 388, 390.

Figure 19:
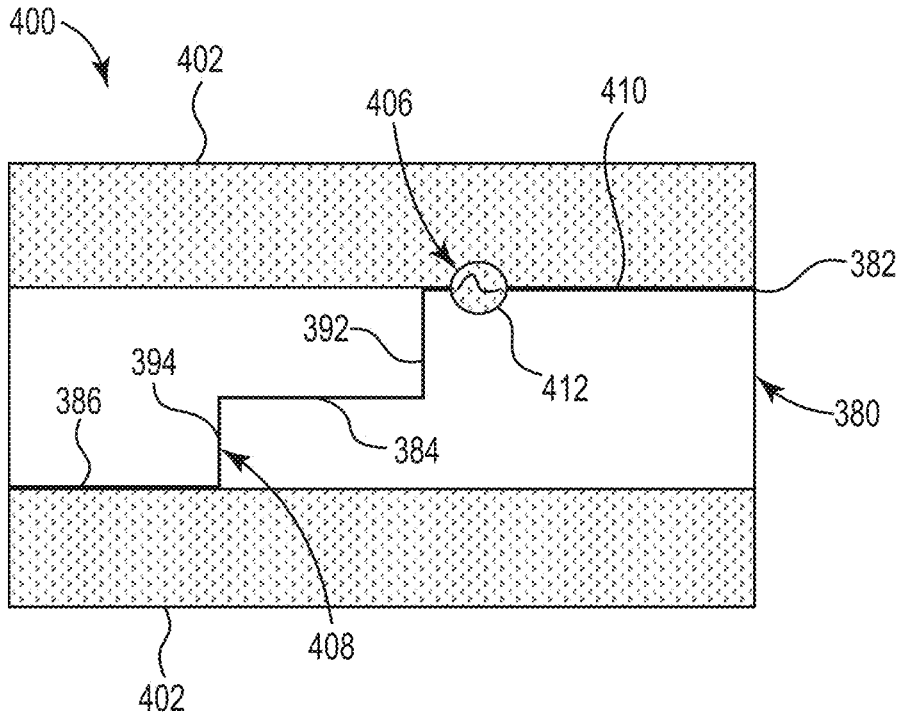
FIG. 19 is a schematic illustration of an antenna structure formed using the printed circuit board of FIG. 18 between two structural elements according to various embodiments of the present disclosure.

FIG. 19 shows antenna structure 400 including structural elements 402, multi-layer PCB 380 between the structural elements, and antenna 406. Antenna 406 may be formed in PCB 380 and be disposed between structural elements 402. Antenna 406 may be formed as a dipole antenna. For example, antenna 406 may include first antenna element 408, second antenna element 410, and antenna feed point 412. Although two structural elements 402 are shown, any suitable number of structural elements 402 may be used in antenna structure 400, including only one structural element, three structural elements, or more.

In the illustrated embodiment, antenna 406 spans more than one layer of PCB 380. For example, first antenna element 408 is formed from at least portions of first conductive layer 382, first conductive via 392, second conductive layer 384, second conductive via 394, and third conductive layer 386. First antenna element 408 may also be described as being non-linear. Antenna feed point 412 may be coupled to one of the conductive layers, such as first conductive layer 382. Second antenna element 410 may be formed from at least a portion of first conductive layer 382. Second antenna element 410 may also be described as being linear. In other embodiments, both antenna elements 408 and 410 may be linear (e.g., formed in one conductive layer) or non-linear (e.g., span multiple layers using conductive vias).

In some embodiments, each structural element 402 may form a different side of an ear-worn device housing or frame (e.g., left side and right side). In particular, each structural element 402 may form a different portion of an outer shell of ear-worn device.

PCB 380 may include one or more functional components, such as a microphone, a button, a processing circuit, a connector, a printed circuit board, etc. One or more of these functional components may be surface mounted to PCB 380 or embedded into PCB 380 (e.g., using an integrated circuit).

Figure 20A:
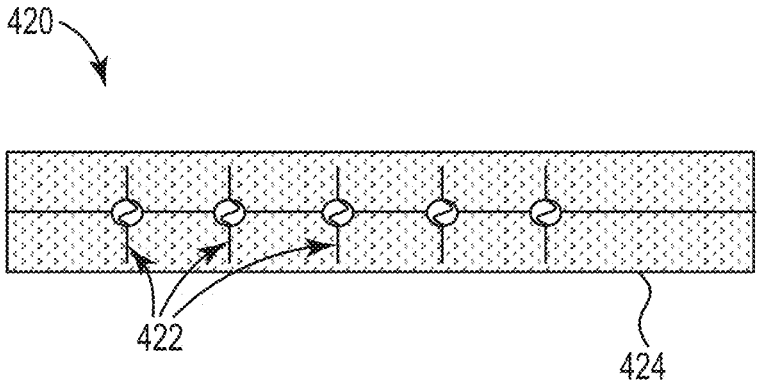
FIGS. 20A-B are schematic illustrations of antenna array structures according to various embodiments of the present disclosure.
Figure 20B:
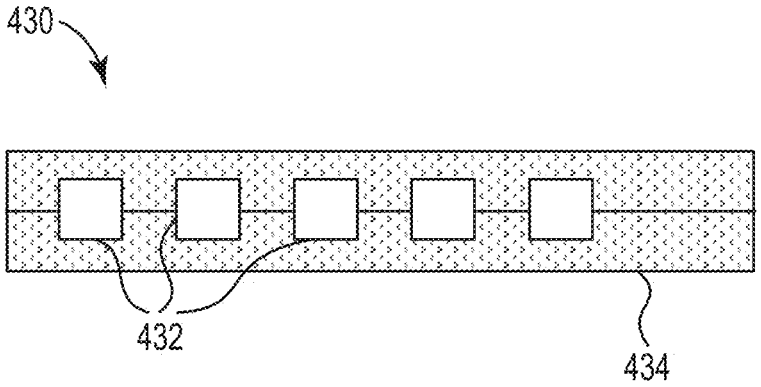

FIGS. 20A-B show two different examples of antenna array structures 420, 430. An antenna array may include two or more antennas, each including one or more antenna elements, and each configured to provide an electric field in response to a driving signal. As illustrated, antenna array structure 420 includes a plurality of dipole antennas 422 arranged into an antenna array. The dipole antennas 422 may be disposed adjacent to, or proximate to, structural element 424. Antenna array structure 430 is similar to antenna array structure 420 except a plurality of patch antennas 432 are used instead of dipole antennas. Patch antennas 432 may be disposed adjacent to, or proximate to, structural element 434. Each of structural element 424, 434 may be formed at least partially, or entirely, of a high-dielectric material. In some embodiments, high-dielectric material of the respective structural element 424, 434 may be positioned between at least two of the antenna elements of antennas 422 or 432.

Figure 21:
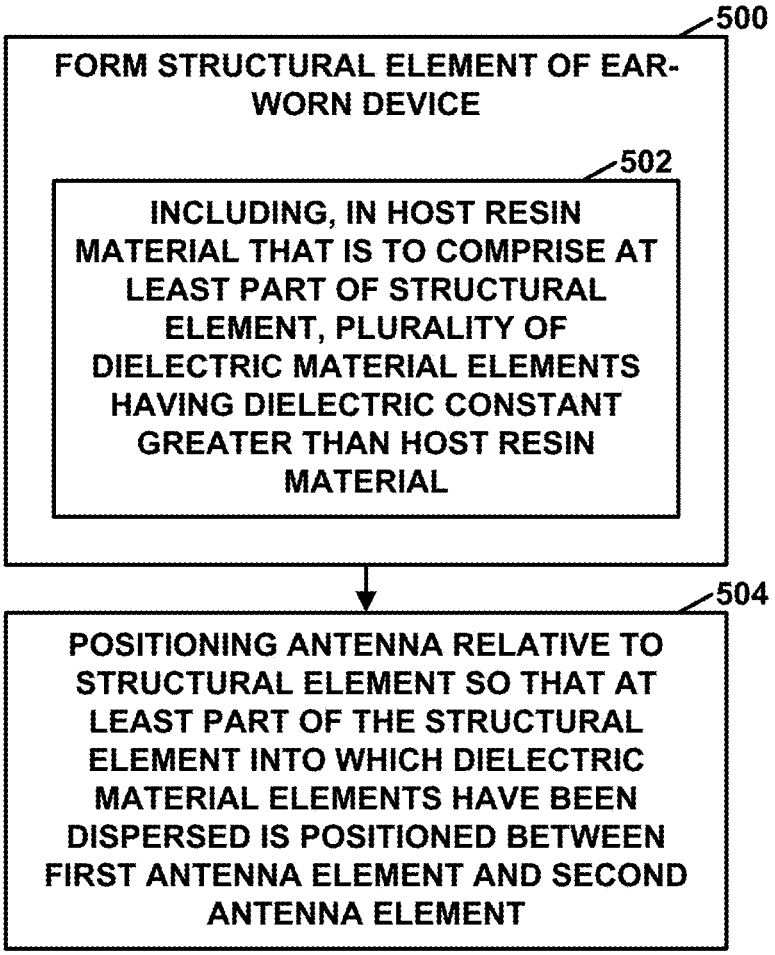
FIG. 21 is a flowchart illustrating an example method of manufacturing an ear-worn device according to various embodiments of the present disclosure.

FIG. 21 is a flowchart illustrating an example method of manufacturing an ear-worn device according to various embodiments of the present disclosure. In the example of FIG. 21, a structural element of the ear-worn device is formed (500). In various examples of the present disclosure, the structural element may be one of: a housing of the ear-worn device (e.g., housing 17 (FIG. 2A), housing 36 (FIG. 4), housing part 264 (FIG. 12), or housing part 284 (FIG. 13)), a shell (e.g., shell 44 (FIG. 5A)) of the ear-worn device, a top case (e.g., top case 50 (FIG. 6)) of the ear-worn device, a battery door (e.g., battery door 32 (FIG. 4), battery door 60 (FIG. 7)) of the ear-worn device, a faceplate (e.g., faceplate 42 (FIG. 5A), faceplate 45 (FIG. 5A, FIG. 5B), etc.) of the ear-worn device, a spine (e.g., frame 70 (FIG. 8)) of the ear-worn device, or another structural element of the ear-worn device. The structural element of the ear-worn device may be an element of the ear-worn device that serves a structural purpose with the ear-worn device. In other words, the structural element of the ear-worn device may serve in a capacity of maintaining a physical arrangement of other components (e.g., batteries, microphones, receivers, circuit boards, sensors, etc.) of the ear-worn device relative to one another. Thus, the structural element does not have the sole purpose of effecting electromagnetic fields produced by an antenna of the ear-worn device. Accordingly, it may be unnecessary to include in the ear-worn device a special-purpose component that includes dielectric material elements for the purpose of effecting the electromagnetic fields produced by the antenna. Avoiding the inclusion of such a special-purpose component may reduce the number of manufacturing steps, may save space within the ear-worn device, and/or may reduce costs associated manufacturing the ear-worn device.

In the example of FIG. 21, as part of forming the structural element, a plurality of dielectric material elements having a dielectric constant greater than the host resin material may be included in the host resin material that is to comprise at least a part of the structural element (502). For instance, in an example where an additive manufacturing process (e.g., 3D printing) is used to form the structural element, the dielectric material elements may be mixed into the host resin material as the host resin material is being deposited to form at least the part of the structural element. In some such examples, the dielectric material elements are not mixed into the host resin material used to form other parts of the structural element. In some examples, an injection molding process may be used to form the structural element. In some such examples, resin with or with the dielectric material elements may be injected into a mold (e.g., at different times and/or from different ports) to form different parts of the structural element. In some examples, all of the resin injected into a mold to form the structural element may include the dielectric material elements. In some examples, a volumetric 3D printing process may be used to form the structural element. For instance, in such examples, a 3D printing apparatus may deposit a first material, forming certain parts of the structural element. The 3D printing apparatus may also deposit a second material, which contains the dielectric material elements, at specific points or as a second layer, on the parts of the structural element formed using the first material. Conversely, in some examples, the 3D printing apparatus may use a material containing dielectric material elements for form parts of the structural element and may then use a material not containing dielectric material elements to form parts of the structural element on the parts of the structural element formed from the material containing the dielectric material elements. The deposition of material containing dielectric material elements at specific locations may result in antennas with desired radiation patterns and/or electrical properties.

Furthermore, in the example of FIG. 21, an antenna may be positioned relative to the structural element so that at least the part of the structural element that includes the dielectric material elements is positioned between a first antenna element (e.g., first antenna element 242 (FIG. 11), first antenna element 302 (FIG. 14), first antenna element 322 (FIG. 15), first antenna element 368 (FIG. 16), etc.) of the antenna and a second antenna element (e.g., second antenna element 244 (FIG. 11), second antenna element 304 (FIG. 14), second antenna element 324 (FIG. 15), second antenna element 370 (FIG. 16), etc.) of the antenna (504). The antenna comprises a conductive material configured to provide an electric field in response to a driving signal. The antenna includes an antenna feed point (e.g., feed point 328 (FIG. 15)) that is coupled to the first antenna element and the second antenna element and is configured to provide the driving signal. Each of the first antenna element and the second antenna element is formed of the conductive material and is configured to provide the electric field in response to the driving signal from the feed point.

The antenna may be positioned relative to the structural element in one of a variety of ways. For example, the antenna may be directly attached to the structural element (e.g., using an adhesive, using one or more fasteners, using a friction fit, etc.), arranged adjacent to the antenna without direct contact, or positioned in another way so that the structural element and the antenna have a stable spatial relationship during use of the antenna. In different examples, a human or a machine, either entirely or partially, may position the antenna relative to the structural element.

The following paragraphs provide a non-limiting set of examples that are in accordance with the techniques of this disclosure.

Example 1. An ear-worn device comprising: an antenna comprising a conductive material configured to provide an electric field in response to a driving signal; and a structural element positioned relative to the antenna, wherein the structural element comprises: a host resin material; and a plurality of dielectric material elements having a dielectric constant greater than the host resin material dispersed in the host resin material to redirect at least part of the electric field toward the structural element.

Example 2. The device of example 1, wherein the structural element is positioned relative to the antenna to redirect at least part of the electric field outside of the ear-worn device.

Example 3. The device of example 1 or 2, wherein the structural element is positioned along only a selected portion of the antenna to increase strength of the electric field proportional to an effective dielectric constant of the structural element in a region proximate to the selected portion of the antenna.

Example 4. The device of any of the preceding numbered examples, wherein the structural element is positioned between conductors of the antenna that correspond to high electric field distribution.

Example 5. The device of any of the preceding numbered examples, wherein the plurality of dielectric material elements is dispersed uniformly, or at least substantially uniformly, in the host resin material.

Example 6. The device of any of the preceding numbered examples, wherein the structural element comprises a faceplate.

Example 7. The device of any of the preceding numbered examples, wherein the structural element defines at least part of an outer surface of a housing of the ear-worn device.

Example 8. The device of any one of examples 1-6, wherein the structural element is contained within a housing of the ear-worn device.

Example 9. The device of any of the preceding numbered examples, wherein a conductor is disposed in the host resin material to provide a ground plane for the antenna.

Example 10. The device of any of the preceding numbered examples, wherein the dielectric material elements are provided as one or more of the following: powder, granular particles, or rods.

Example 11. The device of any of the preceding numbered examples, wherein the host resin material comprises one or more of the following: a polyamide and a polyimide.

Example 12. The device of any of the preceding numbered examples, wherein the plurality of dielectric material elements comprises one or more of the following materials: titanium, tantalum oxide, cerium oxide, and barium zirconium titanium oxide.

Example 13. The device of any of the preceding numbered examples, wherein the structural element comprises dielectric material forming the plurality of dielectric material elements in an amount up to 50 wt.-% of the structural element.

Example 14. The device of any of the preceding numbered examples, wherein the antenna comprises: a first antenna element; a second antenna element; and an antenna source coupled to the first and second antenna elements, wherein the first and second antenna elements and the antenna source define a nominal antenna wavelength corresponding to a physical antenna length, wherein the structural element is coupled to the antenna to define an effective antenna wavelength longer than the nominal antenna wavelength.

Example 15. The device of example 14, wherein one of the first and second antenna elements is positioned at least partially external to a housing of the ear-worn device.

Example 16. The device of example 15, wherein the one of the first and second antenna elements positioned external to the housing is positioned at least partially in a handle.

Example 17. The device of any of the preceding numbered examples, wherein the conductive material of the antenna is formed on a circuit board and the structural element is positioned proximate to the circuit board.

Example 18. The device of any of the preceding numbered examples, wherein the antenna comprises: a conductor; and a slot formed in the conductor defining a length and a width shorter than the length, wherein one or more structural elements are coupled to the conductor and positioned across the width of the slot.

Example 19. The device of any one of examples 1-17, wherein the antenna comprises: a conductive patch element; and a ground plane element, wherein the structural element is positioned between the patch element and the ground plane element.

Example 20. The device of any of the preceding numbered examples, wherein the structural element does not interface with a skin of a wearer when the ear-worn device is worn to concentrate the electric field away from the wearer.

Example 21. The device of example 20, wherein the structural element is positioned proximate to a first side of the antenna opposite to a second side of the antenna, the second side being positioned proximate to a wearer of the ear-worn device to redirect the electric field into a directional pattern away from the wearer.

Example 22. The device of any of the preceding numbered examples, further comprising a reflector, wherein the structural element is positioned between the antenna and the reflector.

Example 23. The device of example 22, wherein the structural element has a quarter-wavelength thickness based on an antenna wavelength of the antenna.

Example 24. The device of any of the preceding numbered examples, wherein the structural element is configured to enhance a surface wave or a creeping wave.

Example 25. The device of example 24, wherein the antenna and structural element are positioned in a recess of an outer surface of a housing of the ear-worn device.

Example 26. The device of any of the preceding numbered examples, wherein the structural element is configured to excite electric field components in a direction perpendicular to an outer surface of a housing of the ear-worn device.

Example 27. The device of example 26, wherein the antenna is disposed on and protruding from the structural element.

Example 28. The device of any of the preceding numbered examples, wherein the structural element is not in contact with the antenna.

Example 29. The device of any of the preceding numbered examples, wherein the structural element is disposed closer to a first side of the antenna than a second side of the antenna, wherein an internal signal line is disposed closer to the second side than the first side.

Example 30. An ear-worn device comprising: an antenna comprising a conductive material configured to provide an electric field in response to a driving signal; and a structural element positioned relative to the antenna configured to cause the electric field to travel along or away from a wearer of the ear-worn device, wherein the structural element has an effective dielectric constant greater than 5.

Example 31. An ear-worn device comprising: a resonating structure comprising a structural element configured to provide an electric field in response to a driving signal, wherein the structural element comprises: a host resin material; and a plurality of dielectric material elements having a dielectric constant greater than the host resin material dispersed in the host resin material to redirect at least part of the electric field toward the structural element; and one or more conductive loading strips coupled to the structural element to tune the resonating structure.

Example 32. The device of example 31, wherein the one or more conductive loading strips are coupled to an outer surface of the structural element to tune the resonating structure.

Example 33. An ear-worn device comprising: an antenna array comprising two or more antenna elements formed of a conductive material configured to provide an electric field in response to a driving signal; and a structural element positioned between at least two of the antenna elements, wherein the structural element comprises: a host resin material; and a plurality of dielectric material elements having a dielectric constant greater than the host resin material dispersed in the host resin material to redirect at least part of the electric field toward the structural element, wherein sizes of the two or more antenna elements are selected based on an effective dielectric constant of the structural element.

Example 34. The device of example 33, wherein the antenna elements are spaced between 0.25 to 1.5 times a nominal antenna wavelength.

The following are another list of non-limiting examples of this disclosure.

Example 1. An ear-worn device comprising: an antenna comprising a conductive material configured to provide an electric field in response to a driving signal, wherein: the antenna includes a first antenna element, a second antenna element, and an antenna feed point, the antenna feed point is coupled to the first antenna element and the second antenna element and configured to provide the driving signal, and each of the first antenna element and the second antenna element is formed of the conductive material and is configured to provide the electric field in response to the driving signal from the feed point; and a structural element, wherein: at least a part of the structural element is positioned between the first antenna element and the second antenna element, the structural element is one of: a housing of the ear-worn device, a shell of the ear-worn device, a top case of the ear-worn device, a battery door of the ear-worn device, a faceplate of the ear-worn device, or a spine of the ear-worn device, and at least the part of the structural element that is positioned between the first antenna element and the second antenna element comprises a host resin material; and a plurality of dielectric material elements having a dielectric constant greater than the host resin material dispersed in the host resin material.

Example 2. The device of example 1, wherein the part of the structural element that is positioned between the first antenna element and the second antenna element does not extend along an entire width of the first antenna element or an entire width of the second antenna element.

Example 3. The device of any of examples 1 or 2, wherein the plurality of dielectric material elements is dispersed uniformly, or at least substantially uniformly, in the host resin material.

Example 4. The device of any of examples 1-3, wherein the structural element comprises a faceplate that, together with the shell of the ear-worn device, defines a volume within which the spine of the ear-worn device is disposed.

Example 5. The device of any of examples 1-3, wherein: the structural element is the top case of the ear-worn device, and the top case at least partially covers internal electronic components of the ear-wearable device.

Example 6. The device of any of examples 1-3, wherein: the structural element is the battery door of the ear-worn device, and a battery of the ear-worn device is configured to be retained by the battery door of the ear-worn device.

Example 7. The device of any of examples 1-3, wherein: the structural element is the housing of the ear-worn device, and one or more parts of the housing of the ear-worn device other than the part of the structural element that is positioned between the first antenna element and the second antenna element comprises the host resin material without any dielectric material elements having the dielectric constant greater than the host resin material.

Example 8. The device of any of examples 1-7, wherein the antenna is a dipole antenna.

Example 9. The device of any of examples 1-8, wherein: the first antenna element and the second antenna element are each substantially planar and elongate along a length of the ear-worn device, the first antenna element is disposed on a left side of the ear-worn device, and the second antenna element is disposed on a right side of the ear-worn device.

Example 10. The device of any one of examples 1-8, wherein: the first antenna element is a conductive patch element; and the second antenna element is a ground plane element.

Example 11. The device of any of examples 1-10, wherein: the first and second antenna elements and the antenna source define a nominal antenna wavelength corresponding to a physical antenna length, and the structural element is coupled to the antenna to define an effective antenna wavelength longer than the nominal antenna wavelength.

Example 12. An ear-worn device comprising: an antenna comprising a conductive material configured to provide an electric field in response to a driving signal, wherein: the antenna includes a first antenna element, a second antenna element, and an antenna feed point, the antenna feed point is coupled to the first antenna element and the second antenna element and configured to provide the driving signal, and each of the first antenna element and the second antenna element is formed of the conductive material and is configured to provide the electric field in response to the driving signal from the feed point; internal electronic components; a housing of the ear-worn device that at least partially covers the internal electronic components of the ear-worn device, wherein the housing comprises a host resin material; and a plurality of dielectric material elements having a dielectric constant greater than the host resin material dispersed in the host resin material.

Example 13. A method of manufacturing an ear-worn device, the method comprising: forming a structural element of the ear-worn device, wherein: the structural element is one of: a housing of the ear-worn device, a shell of the ear-worn device, a top case of the ear-worn device, a battery door of the ear-worn device, a faceplate of the ear-worn device, or a spine of the ear-worn device, and forming the structural element comprises including, in a host resin material that is to comprise at least a part of the structural element, a plurality of dielectric material elements having a dielectric constant greater than the host resin material; and attaching an antenna to the structural element so that at least the part of the structural element that includes the dielectric material elements is positioned between a first antenna element of the antenna and a second antenna element of the antenna, wherein: the antenna comprises a conductive material configured to provide an electric field in response to a driving signal, the antenna includes an antenna feed point that is coupled to the first antenna element and the second antenna element and is configured to provide the driving signal, and each of the first antenna element and the second antenna element is formed of the conductive material and is configured to provide the electric field in response to the driving signal from the feed point.

Example 14. The method of example 13, wherein the method includes steps to manufacture the ear-worn device defined in any of examples 2-11.

Thus, various embodiments of EAR-WORN DEVICES WITH HIGH-DIELECTRIC STRUCTURAL ELEMENTS are disclosed. Although reference is made herein to the accompanying set of drawings that form part of this disclosure, one of at least ordinary skill in the art will appreciate that various adaptations and modifications of the embodiments described herein are within, or do not depart from, the scope of this disclosure. For example, aspects of the embodiments described herein may be combined in a variety of ways with each other. Therefore, it is to be understood that, within the scope of the appended claims, the claimed invention may be practiced other than as explicitly described herein.

All references and publications cited herein are expressly incorporated herein by reference in their entirety for all purposes, except to the extent any aspect directly contradicts this disclosure.

All scientific and technical terms used herein have meanings commonly used in the art unless otherwise specified. The definitions provided herein are to facilitate understanding of certain terms used frequently herein and are not meant to limit the scope of the present disclosure.

Unless otherwise indicated, all numbers expressing feature sizes, amounts, and physical properties used in the specification and claims may be understood as being modified either by the term "exactly" or "about." Accordingly, unless indicated to the contrary, the numerical parameters set forth in the foregoing specification and attached claims are approximations that can vary depending upon the desired properties sought to be obtained by those skilled in the art utilizing the teachings disclosed herein or, for example, within typical ranges of experimental error.

The recitation of numerical ranges by endpoints includes all numbers subsumed within that range (e.g. 1 to 5 includes 1, 1.5, 2, 2.75, 3, 3.80, 4, and 5) and any range within that range. Herein, the terms "up to" or "no greater than" a number (e.g., up to 50) includes the number (e.g., 50), and the term "no less than" a number (e.g., no less than 5) includes the number (e.g., 5).

Unless otherwise noted, all parts, percentages, ratios, etc. are by weight.

The terms "coupled" or "connected" refer to elements being attached to each other either directly (in direct contact with each other) or indirectly (having one or more elements between and attaching the two elements). Either term may be modified by "operatively" and "operably," which may be used interchangeably, to describe that the coupling or connection is configured to allow the components to interact to carry out at least some functionality.

Terms related to orientation, such as "top," "bottom," "side," "end," "left," or "right" are used to describe relative positions of components and are not meant to limit the orientation of the embodiments contemplated. For example, an embodiment described as having a "top" and "bottom" also encompasses embodiments thereof rotated in various directions unless the content clearly dictates otherwise.

Reference to "one embodiment," "an embodiment," "certain embodiments," or "some embodiments," etc., means that a particular feature, configuration, composition, or characteristic described in connection with the embodiment is included in at least one embodiment of the disclosure. Thus, the appearances of such phrases in various places throughout are not necessarily referring to the same embodiment of the disclosure. Furthermore, the particular features, configurations, compositions, or characteristics may be combined in any suitable manner in one or more embodiments.

The words "preferred" and "preferably" refer to embodiments of the disclosure that may afford certain benefits, under certain circumstances. However, other embodiments may also be preferred, under the same or other circumstances. Furthermore, the recitation of one or more preferred embodiments does not imply that other embodiments are not useful and is not intended to exclude other embodiments from the scope of the disclosure.

As used in this specification and the appended claims, the singular forms "a," "an," and "the" encompass embodiments having plural referents, unless the content clearly dictates otherwise. As used in this specification and the appended claims, the term "or" is generally employed in its sense including "and/or" unless the content clearly dictates otherwise.

As used herein, "have," "having," "include," "including," "comprise," "comprising" or the like are used in their open-ended sense, and generally mean "including, but not limited to." It will be understood that "consisting essentially of," "consisting of," and the like are subsumed in "comprising," and the like.

The term "and/or" means one or all of the listed elements or a combination of at least two of the listed elements.

The phrases "at least one of," "comprises at least one of," and "one or more of" followed by a list refers to any one of the items in the list and any combination of two or more items in the list.

What is claimed is:

1. An ear-worn device comprising:

an antenna comprising a conductive material configured to provide an electric field in response to a driving signal, wherein:

the antenna includes a first antenna element, a second antenna element, and an antenna feed point, the antenna feed point is coupled to the first antenna element and the second antenna element and configured to provide the driving signal, and each of the first antenna element and the second antenna element is formed of the conductive material and is configured to provide the electric field in response to the driving signal from the feed point; and a structural element, wherein:

at least a part of the structural element is positioned between the first antenna element and the second antenna element, the structural element is one of: a housing of the ear-worn device, a shell of the ear-worn device, a top case of the ear-worn device, a battery door of the ear-worn device, a faceplate of the ear-worn device, or a spine of the ear-worn device, and at least the part of the structural element that is positioned between the first antenna element and the second antenna element comprises a host material; and a plurality of dielectric material elements having a dielectric constant greater than the host material dispersed in the host material.

2. The device of claim 1, wherein the part of the structural element that is positioned between the first antenna element and the second antenna element does not extend along an entire width of the first antenna element or an entire width of the second antenna element.

3. The device of claim 1, wherein the plurality of dielectric material elements is dispersed uniformly, or at least substantially uniformly, in the host material.

4. The device of claim 1, wherein the structural element comprises a faceplate that, together with the shell of the ear-worn device, defines a volume within which the spine of the ear-worn device is disposed.

5. The device of claim 1, wherein:

the structural element is the top case of the ear-worn device, and the top case at least partially covers internal electronic components of the ear-wearable device.

6. The device of claim 1, wherein:

the structural element is the battery door of the ear-worn device, and a battery of the ear-worn device is configured to be retained by the battery door of the ear-worn device.

7. The device of claim 1, wherein:

the structural element is the housing of the ear-worn device, and one or more parts of the housing of the ear-worn device other than the part of the structural element that is positioned between the first antenna element and the second antenna element comprises the host material without any dielectric material elements having the dielectric constant greater than the host resin material.

8. The device of claim 1, wherein the antenna is a dipole antenna.

9. The device of claim 1, wherein:

the first antenna element and the second antenna element are each substantially planar and elongate along a length of the ear-worn device, the first antenna element is disposed on a left side of the ear-worn device, and the second antenna element is disposed on a right side of the ear-worn device.

10. The device of claim 1, wherein:

the first antenna element is a conductive patch element; and the second antenna element is a ground plane element.

11. The device of claim 1, wherein:

the first and second antenna elements and the antenna source define a nominal antenna wavelength corresponding to a physical antenna length, and the structural element is coupled to the antenna to define an effective antenna wavelength longer than the nominal antenna wavelength.

12. An ear-worn device comprising:

an antenna comprising a conductive material configured to provide an electric field in response to a driving signal, wherein:

the antenna includes a first antenna element, a second antenna element, and an antenna feed point, the antenna feed point is coupled to the first antenna element and the second antenna element and configured to provide the driving signal, and each of the first antenna element and the second antenna element is formed of the conductive material and is configured to provide the electric field in response to the driving signal from the feed point;

internal electronic components;

a housing of the ear-worn device that at least partially covers the internal electronic components of the ear-worn device, wherein the housing comprises a host material; and a plurality of dielectric material elements having a dielectric constant greater than the host material dispersed in the host material.

13. A method of manufacturing an ear-worn device, the method comprising:

forming a structural element of the ear-worn device, wherein:

the structural element is one of: a housing of the ear-worn device, a shell of the ear-worn device, a top case of the ear-worn device, a battery door of the ear-worn device, a faceplate of the ear-worn device, or a spine of the ear-worn device, and forming the structural element comprises including, in a host material that is to comprise at least a part of the structural element, a plurality of dielectric material elements having a dielectric constant greater than the host material; and attaching an antenna to the structural element so that at least the part of the structural element that includes the dielectric material elements is positioned between a first antenna element of the antenna and a second antenna element of the antenna, wherein:

the antenna comprises a conductive material configured to provide an electric field in response to a driving signal, the antenna includes an antenna feed point that is coupled to the first antenna element and the second antenna element and is configured to provide the driving signal, and each of the first antenna element and the second antenna element is formed of the conductive material and is configured to provide the electric field in response to the driving signal from the feed point.

* * * * *